US010930216B2

(12) United States Patent
Yi et al.

(10) Patent No.: US 10,930,216 B2
(45) Date of Patent: Feb. 23, 2021

(54) DISPLAY DEVICE AND METHOD OF DRIVING THE SAME

(71) Applicant: Samsung Display Co., Ltd., Yongin-si (KR)

(72) Inventors: Jung Hun Yi, Yongin-si (KR); Seung Kyu Lee, Yongin-si (KR); Ki Wook Kim, Yongin-si (KR); Yang Wan Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/512,255

(22) Filed: Jul. 15, 2019

(65) Prior Publication Data

US 2020/0082758 A1 Mar. 12, 2020

(30) Foreign Application Priority Data

Sep. 6, 2018 (KR) ..... 10-2018-0106687

(51) Int. Cl.
*G09G 3/3258* (2016.01)
*G09G 3/3275* (2016.01)
*G09G 3/3266* (2016.01)

(52) U.S. Cl.
CPC ..... *G09G 3/3258* (2013.01); *G09G 3/3275* (2013.01); *G09G 3/3266* (2013.01); *G09G 2310/0297* (2013.01)

(58) Field of Classification Search
CPC .. G09G 3/3258; G09G 3/3275; G09G 3/3266; G09G 3/3233; G09G 2300/0426;
(Continued)

(56) References Cited

U.S. PATENT DOCUMENTS 9,076,382 B2 7/2015 Choi
2007/0242016 A1* 10/2007 Choi ..... G09G 3/3233 345/92

(Continued)

FOREIGN PATENT DOCUMENTS

EP 1847982 10/2007
KR 10-2016-0108639 9/2016

OTHER PUBLICATIONS

Extended European Search Report dated Jan. 2, 2020, issued in European Patent Application No. 19195964.2.

*Primary Examiner* — Brent D Castiaux
(74) *Attorney, Agent, or Firm* — H.C. Park & Associates, PLC

(57) ABSTRACT

A display device and a method of driving the same. The display device may include: a first pixel area including first pixels and first data lines coupled to the first pixels; a second pixel area including second pixels and second data lines coupled to the second pixels; a first non-pixel area disposed on one side of the first pixel area such that the first non-pixel area borders the first and second pixel areas; a data driver configured to output data signals corresponding to the first and second pixels through first and second output lines, respectively; and a switch unit including a first switch unit having a demux configured to alternately couple each of the first output lines to corresponding first data lines, and a second switch unit configured to couple the second output lines to the respective different second data lines.

20 Claims, 21 Drawing Sheets

(58) Field of Classification Search
CPC ... G09G 2310/0297; G09G 2320/0209; G09G 3/2074; G09G 3/3208; G09G 3/3291
See application file for complete search history.

(56) References Cited

U.S. PATENT DOCUMENTS

| | | | | |
|---|---|---|---|---|
| 2010/0156776 | A1* | 6/2010 | Jeoung | G09G 3/3688 345/98 |
| 2015/0356910 | A1* | 12/2015 | Cho | G09G 3/3275 345/214 |
| 2016/0260367 | A1 | 9/2016 | Kwak et al. | |
| 2017/0154566 | A1 | 6/2017 | Ryoo et al. | |
| 2018/0158417 | A1* | 6/2018 | Xiang | G09G 3/3233 |
| 2018/0166017 | A1* | 6/2018 | Li | G09G 3/3233 |

* cited by examiner

DISPLAY DEVICE AND METHOD OF DRIVING THE SAME

CROSS REFERENCE TO RELATED APPLICATION

This application claims priority from and the benefit of Korean Patent Application No. 10-2018-0106687, filed on Sep. 6, 2018, which is hereby incorporated by reference for all purposes as if fully set forth herein.

BACKGROUND

Field

Embodiments of the invention relate to a display device and a method of driving the same.

Discussion of the Background

Generally, a display device includes pixels coupled to scan lines and data lines, a scan driver configured to supply scan signals to the scan lines, and a data driver configured to supply data signals to the data lines. The display device may selectively include a demultiplexer (hereinafter "demux") configured to supply data signals output from respective output lines of the data driver to the corresponding data lines in a time-sharing manner. In a display device including a demux, the number of channels of the data driver may be reduced, and the sizes of a driving circuit unit and a non-display area may be reduced.

The above information disclosed in this Background section is only for understanding of the background of the inventive concepts, and, therefore, it may contain information that does not constitute prior art.

SUMMARY

Devices and methods according to embodiments of the invention are directed to a display device and a method of driving the same capable of reducing the size of a non-display area and providing uniform image quality on the entirety of a display area.

Additional features of the inventive concepts will be set forth in the description which follows, and in part will be apparent from the description, or may be learned by practice of the inventive concepts.

An embodiment of the inventive concepts may provide a display device including: a first pixel area including first pixels and first data lines coupled to the first pixels; a second pixel area including second pixels and second data lines coupled to the second pixels, and having a length less than a length of the first pixel area with respect to a first direction, the second pixel area being disposed on one side of the first pixel area with respect to a second direction; a first non-pixel area disposed on the one side of the first pixel area with respect to the second direction such that the first non-pixel area borders the first and second pixel areas; a data driver configured to output data signals corresponding to the first and second pixels through first and second output lines, respectively; and a switch unit coupled between the first and second output lines and the first and second data lines. The switch unit may include: a first switch unit including a demultiplexer (demux) configured to alternately couple each of the first output lines to a plurality of corresponding first data lines; and a second switch unit configured to couple the second output lines to the respective different second data lines.

In an embodiment, the second switch unit may include a plurality of second switches configured to couple the second output lines with the second data lines at a ratio of 1:1.

In an embodiment, the first switch unit may include a plurality of first switches configured to couple the first output lines with the first data lines at a ratio of 1:N ("N" is a natural number of 2 or more).

In an embodiment, the demux may include: a 1-1-th switch configured to be turned on in response to a first control signal so that one of the first output lines is coupled to one of the first data lines; and a 1-2-th switch configured to be turned on in response to a second control signal so that the one of the first output lines is coupled to another one of the first data lines.

In an embodiment, the first and second control signals may respectively have turn-on voltages at different timings.

In an embodiment, the 1-1-th and 1-2-th switches may be respectively coupled to two first data lines disposed adjacent to each other in the first pixel area.

In an embodiment, the 1-1-th and 1-2-th switches may be disposed adjacent to each other.

In an embodiment, the 1-1-th and 1-2-th switches may be respectively coupled to first data lines connected to first pixels that are provided to emit same color light and disposed on two different columns in the first pixel area.

In an embodiment, the second switch unit may include a plurality of second switches configured to be simultaneously turned on in response to one of the first and second control signals so that the second output lines are simultaneously coupled to the respectively second data lines.

In an embodiment, the second switch unit may include a plurality of second switches configured to be alternately turned on in response to the first and second control signals so that each of the second output lines is coupled to a corresponding one of the second data lines.

In an embodiment, the first data lines may extend from the first pixel area in the first direction and be coupled to the data driver through the first switch unit. The second data lines may extend from the second pixel area in the first direction, pass through the first non-pixel area, and be coupled to the data driver through the second switch unit.

In an embodiment, the first data lines may be arranged in the first pixel area at a first interval. The second data lines may be arranged in at least one portion of the first non-pixel area at a second interval less than the first interval.

In an embodiment, the second data lines may be arranged in the second pixel area at the first interval.

In an embodiment, during a first period of each horizontal period, the data driver may output, to the first output lines, data signals of first pixels coupled to a first group of first data lines. During a second period of the each horizontal period, the data driver may output, to the first output lines, data signals of first pixels coupled to a second group of first data lines.

In an embodiment, during each horizontal period, the data driver may alternately output, to a first group of second output lines, data signals of second pixels coupled to a first group of second data lines and data signals of second pixels coupled to a second group of second data lines. During the each horizontal period, the data driver may swap the data signals that are output to the first group of second output lines, and output the swapped data signals to a second group of second output lines.

In an embodiment, the display device may further include a third pixel area disposed on the one side of the first pixel area such that the third pixel area faces the second pixel area with the first non-pixel area interposed therebetween, and borders the first pixel area and the first non-pixel area.

In an embodiment, the third pixel area may include third pixels coupled to the second data lines.

An embodiment of the inventive concepts may provide a method of driving a display device including a first pixel area, and a second pixel area and a first non-pixel area which are disposed on one side of the first pixel area. The method may include: alternately coupling each of first output lines of a data driver to a plurality of first data lines disposed in the first pixel area, in response to first and second control signals sequentially supplied during each horizontal period; and coupling, at a ratio of 1:1, second output lines of the data driver to second data lines disposed in the second pixel area, in response to at least one of the first and second control signal during the each horizontal period.

In an embodiment, the second output lines may be simultaneously coupled to the second data lines in response to one of the first and second control signals during the each horizontal period.

In an embodiment, some of the second output lines may be respectively coupled to corresponding ones of the second data lines in response to the first control signal during a first period of the each horizontal period. Some of the second output lines may be respectively coupled to corresponding ones of the second data lines in response to the second control signal during a second period of the each horizontal period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the inventive concepts.

DETAILED DESCRIPTION

Figure 1:
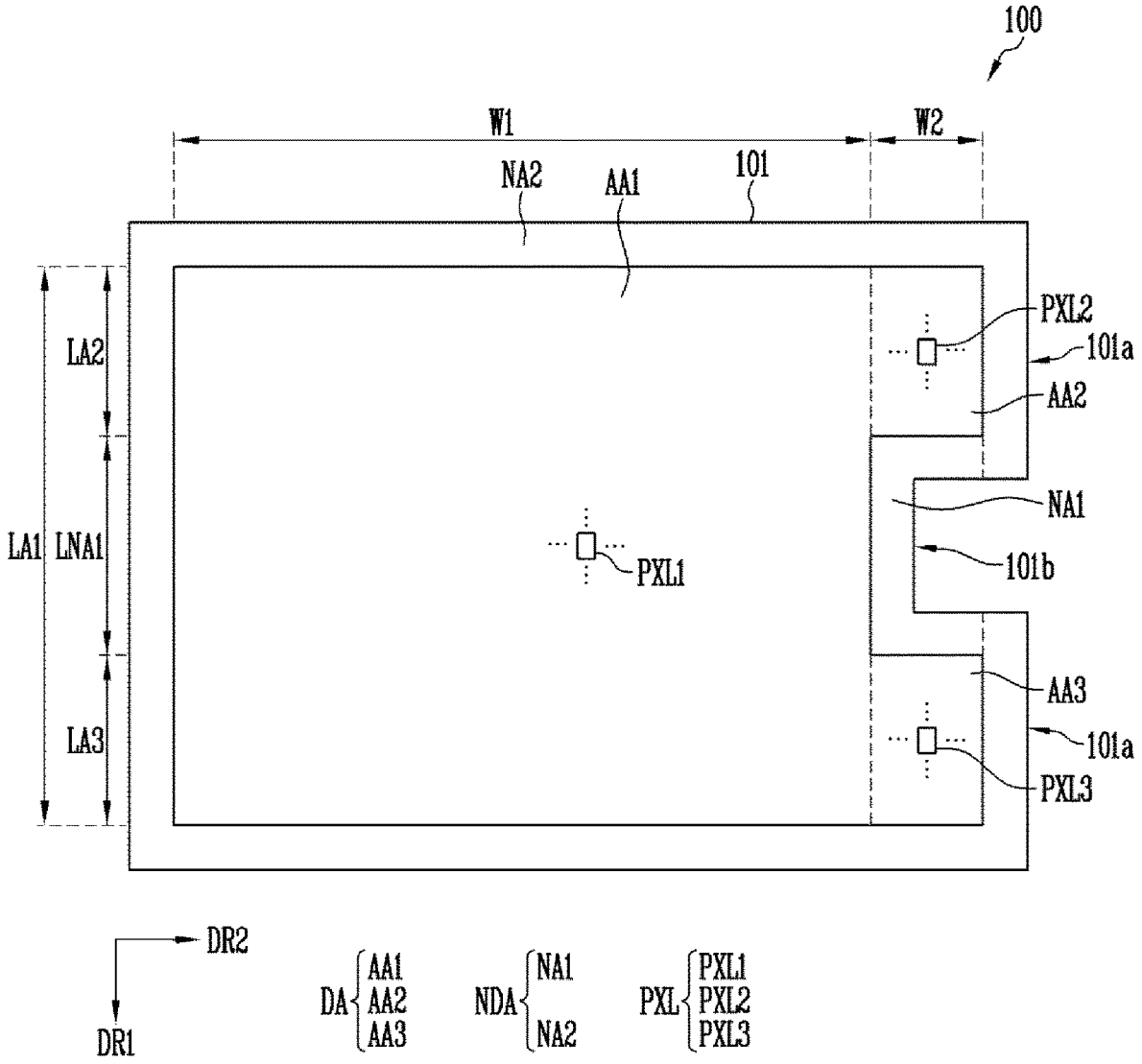
FIG. 1, FIG. 2, FIG. 3, FIG. 4, FIG. 5, FIG. 6, and FIG. 7 are diagrams illustrating display panels in accordance with respective embodiments of the inventive concepts.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the DR1-axis, the DR2-axis, and the DR3-axis are not limited to three axes of a rectangular coordinate system, such as the x, y, and z-axes, and may be interpreted in a broader sense. For example, the DR1-axis, the DR2-axis, and the DR3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various embodiments are described herein with reference to sectional and/or exploded illustrations that are schematic illustrations of idealized embodiments and/or intermediate structures. As such, variations from the shapes of the illustrations as a result, for example, of manufacturing techniques and/or tolerances, are to be expected. Thus, embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIGS. 1, 2, 3, 4, 5, 6, and 7 are diagrams illustrating display panels 100 in accordance with respective embodiments. In detail, FIGS. 1 to 7 are plan views illustrating respective different examples pertaining to the shape of a display panel 100 which may be applied to the display device in accordance with an embodiment of the inventive concepts. For the sake of explanation, each of FIGS. 1 to 7 schematically illustrates the structure of a display panel 100, focusing on a display area DA. Here, although not shown, the display panel 100 may further selectively include at least one driving circuit unit (e.g., a scan driver and/or a data driver).

Referring to FIG. 1, the display panel 100 may include a substrate 101, and a plurality of pixels PXL disposed on the substrate 101. The pixels PXL may be disposed in a display area DA on the substrate 101.

The substrate 101 may form a base substrate of the display panel 100. The substrate 101 may be made of glass or plastic, but the material thereof is not limited thereto. For example, the substrate 101 may be a flexible substrate including at least one material of polyethersulfone (PES), polyacrylate, polyetherimide (PEI), polyethylene naphthalate (PEN), polyethylene terephthalate (PET), polyphenylene sulfide (PPS), polyarylate (PAR), polyimide (PI), polycarbonate (PC), triacetate cellulose (TAC), and cellulose acetate propionate (CAP). Alternatively, the substrate 101 may be a rigid substrate including one of glass and tempered glass.

The substrate 101 may be a substrate made of transparent material, in other words, a transparent substrate, but it is not limited thereto. Furthermore, the substrate 101 may have different materials and/or structures depending on areas so that the areas of the substrate 101 may have different characteristics. The substrate 101 may have a single-layer or multi-layer structure, and the structure thereof is not specifically limited.

An area of the substrate 101 may be defined as a display area DA, and the other area may be defined as a non-display area NDA. The display area DA may be an area including the pixels PXL provided to display an image. The non-display area NDA is an area other than the display area DA, for example, may be a peripheral area enclosing the display area DA.

In an embodiment, the display area DA may have a non-rectangular shape, but it is not limited thereto. For example, the display area DA may have a shape in which a portion thereof protrudes or is recessed. Alternatively, the display area DA may have at least one opening.

For example, the display area DA may include a first pixel area AA1, and second and third pixel areas AA2 and AA3 which are disposed on a first side of the first pixel area AA1 and spaced apart from each other. For example, the second and third pixel areas AA2 and AA3 may protrude from the first side of the first pixel area AA1. A first non-pixel area NA1 may be formed between the second and third pixel areas AA2 and AA3. In the following descriptions of the present embodiment, a non-display area NDA between the second and third pixel areas AA2 and AA3 will be referred to as "first non-pixel area NA1", and the other non-display area NDA, i.e., a peripheral area enclosing the display area DA and the first non-pixel area NA1, will be referred to as "second non-pixel area NA2. In other words, the non-display area NDA may include the first and second non-pixel areas NA1 and NA2.

In an embodiment, the substrate 101 may have a shape corresponding to that of the display area DA. For example, the substrate 101 may have protrusions 101*a* corresponding to the second and third pixel areas AA2 and AA3, and a recess 101*b* corresponding to the first non-pixel area NA1. For example, the substrate 101 may include at least one opening or the recess 101*b* which is formed between the second and third pixel areas AA2 and AA3.

The first pixel area AA1, the second pixel area AA2, and the third pixel area AA3 may respectively include first pixels PXL1, second pixels PXL2, and third pixels PXL3. In an embodiment, the first, second, and third pixels PXL1, PXL2, and PXL3 may substantially have the same configuration, or may have different configurations.

In an embodiment, at least two pixel areas of the first, second, and third pixel areas AA1, AA2, and AA3 may have different widths, lengths, areas, and/or shapes. For example, the first pixel area AA1 may have a greatest width W1 and a greatest length LA1 among those of the pixel areas, and may have the largest portion of the display area DA. For example, the width W1 of the first pixel area AA1 may be greater than a width W2 of the second or third pixel area AA2 or AA3, and the length LA1 of the first pixel area AA1 may correspond to the sum of lengths LA2 and LA3 of the second and third pixel areas AA2 and AA3 and a length LNA1 of the first non-pixel area NA1.

In an embodiment, the display area DA may be a landscape-type display area having a screen with a horizontal length greater than a vertical length. For example, a horizontal length of the display area DA along a second direction DR2, i.e., the sum of the widths W1 and W2 of the first and second pixel areas AA1 and AA2, may be greater than a vertical length of the display area DA along a first direction DR1, i.e., the length LA1 of the first pixel area AA1.

Each of the second and third pixel areas AA2 and the third pixel area AA3 may have the width W2 and the length LA2, LA3 which are less than those of the first pixel area AA1, and may have a surface area less than that of the first pixel area AA1. The second pixel area AA2 and the third pixel area AA3 may have the same shape and/or surface area, or may have different shapes and/or surface areas. In other words, the shape of the display area DA may be changed in various ways.

In an embodiment, the second pixel area AA2 may have, along the first direction DR1, the length LA2 less than that of the first pixel area AA1, and may be disposed on the first side of the first pixel area AA1 with respect to the second direction DR2. Here, the first direction DR1 and the second direction DR may be different directions intersecting each other. For example, the first direction DR1 may be the vertical direction of the display panel 100, and the second direction DR2 may be the horizontal direction of the display panel 100.

In an embodiment, the third pixel area AA3 may have, along the first direction DR1, the length LA3 less than that of the first pixel area AA1, and may be disposed on the first side of the first pixel area AA1 with respect to the second direction DR2 such that the third pixel area AA3 borders the first pixel area AA1 and the first non-pixel area NA1. For example, the third pixel area AA3 may be disposed on the first side of the first pixel area AA1 in such a way that the third pixel area AA3 faces the second pixel area AA2 with the first non-pixel area NA1 interposed therebetween. In other words, in an embodiment, the second and third pixel areas AA2 and AA3 may be disposed on the same side of the first pixel area AA1 at positions facing each other with the first non-pixel area NA1 interposed between the second and third pixel areas AA2 and AA3. For example, the second pixel area AA2 may be disposed on an upper portion of the right side of the first pixel area AA1, and the third area AA3 may be disposed on a lower portion of the right side of the first pixel area AA1.

The first non-pixel area NA1 may be disposed on the first side of the first pixel area AA1 such that the first non-pixel area NA1 borders the first, second, and third pixel areas AA1, AA2, and AA3. For example, the first non-pixel area NA1 may be disposed on an intermediate portion of the right side of the first pixel area AA1.

Figure 2:
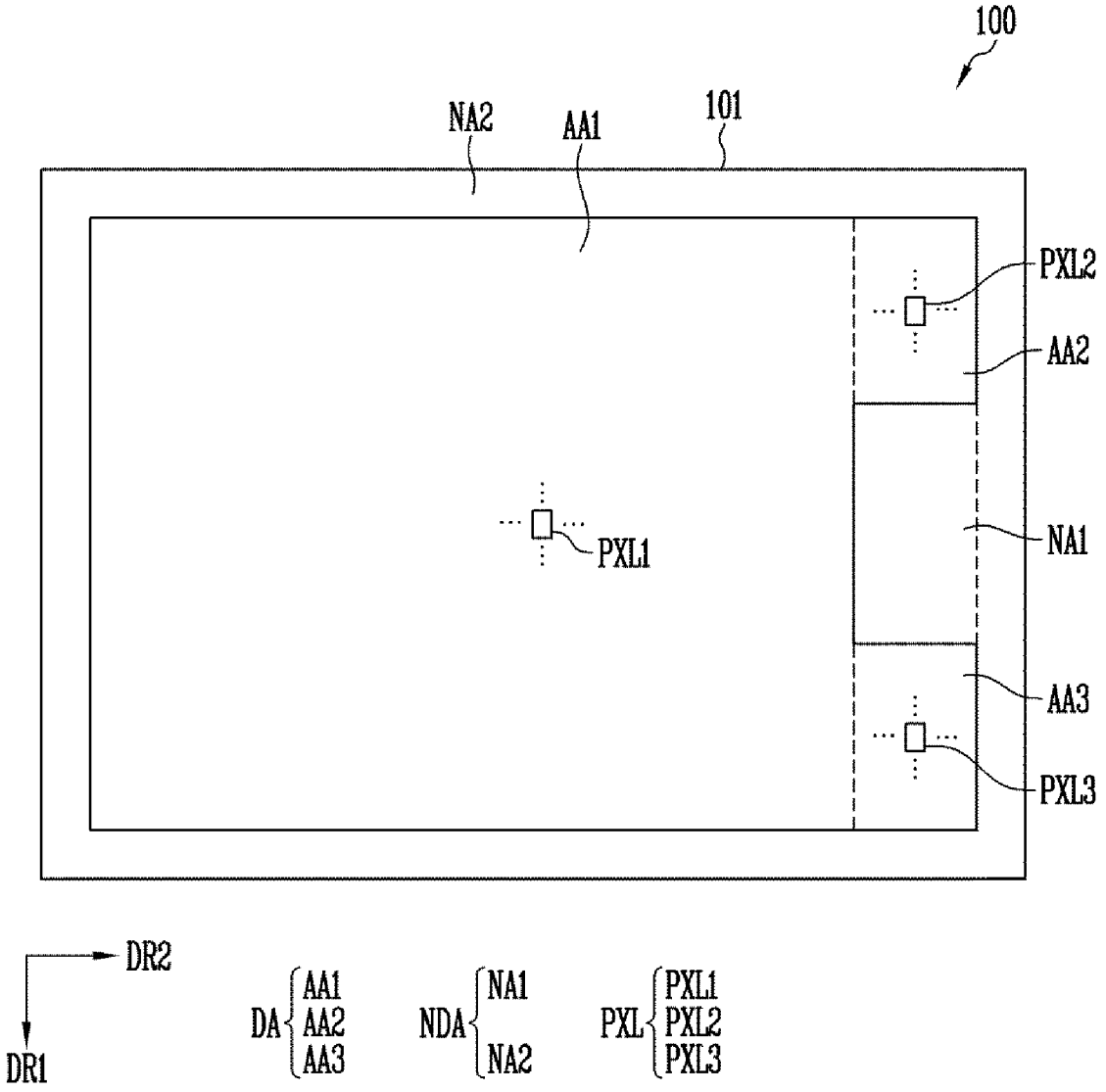

Referring to FIG. 2, the substrate 101 may have a predetermined shape regardless of the shape of the display area DA. For example, although the display area DA has a recess formed between the second and third pixel areas AA2 and AA3, the substrate 101 may have a rectangular shape without including an opening or a recess.

Figure 3:
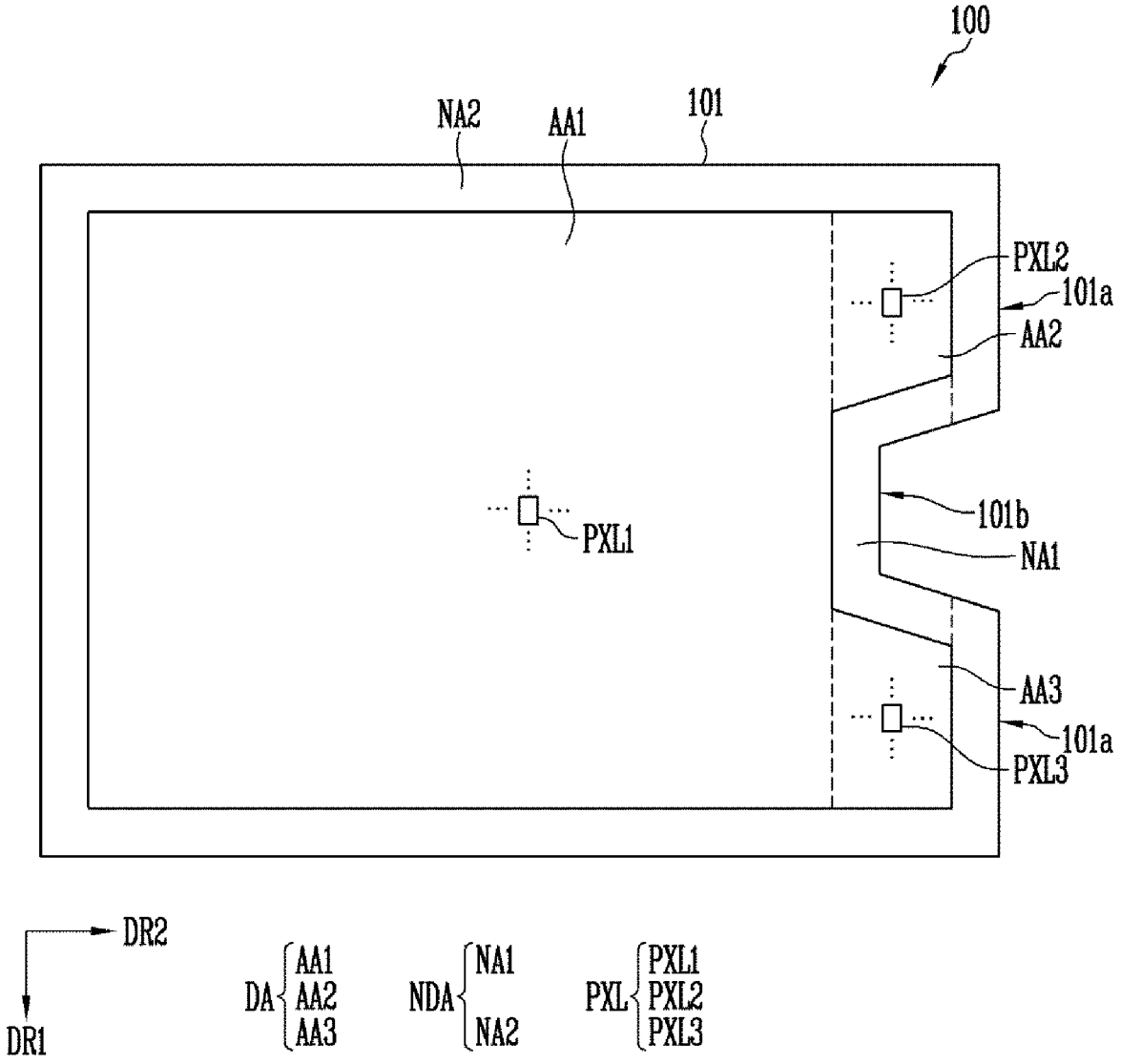

Referring to FIG. 3, at least a portion of the display area DA may have an oblique side inclined with respect to the first and second directions DR1 and DR2. In this case, the substrate 101 may also have an oblique side to correspond to the shape of the display area DA, but it is not limited thereto.

Figure 4:
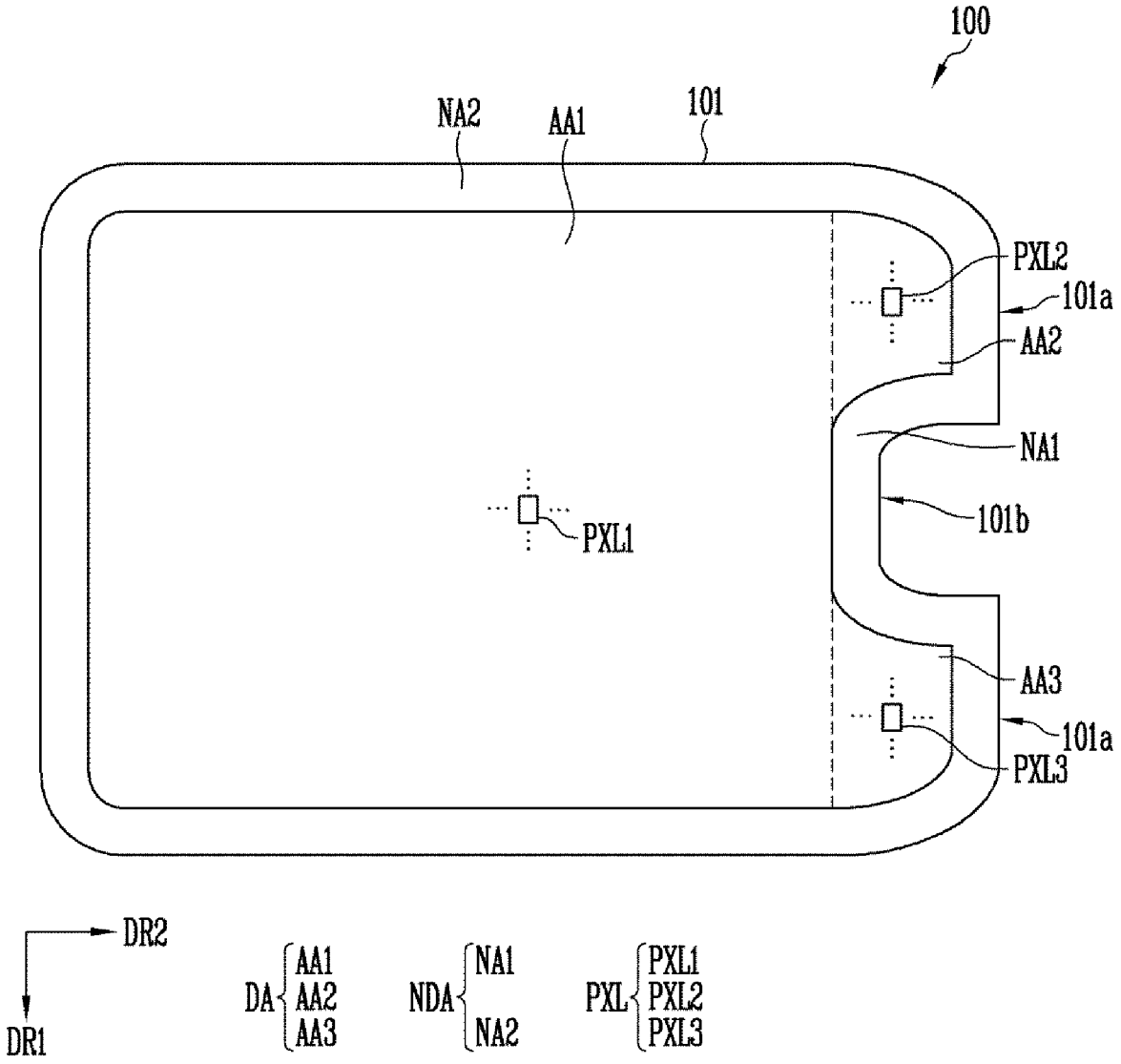

Referring to FIG. 4, at least a portion, e.g., at least one corner, of the display area DA and/or the substrate 101 may be rounded to have a curved line. Alternatively, in an embodiment, at least a portion of the display area DA and/or the substrate 101 may have a stepped shape in which the width and/or length thereof gradually varies from one end to the other end.

Figure 5:
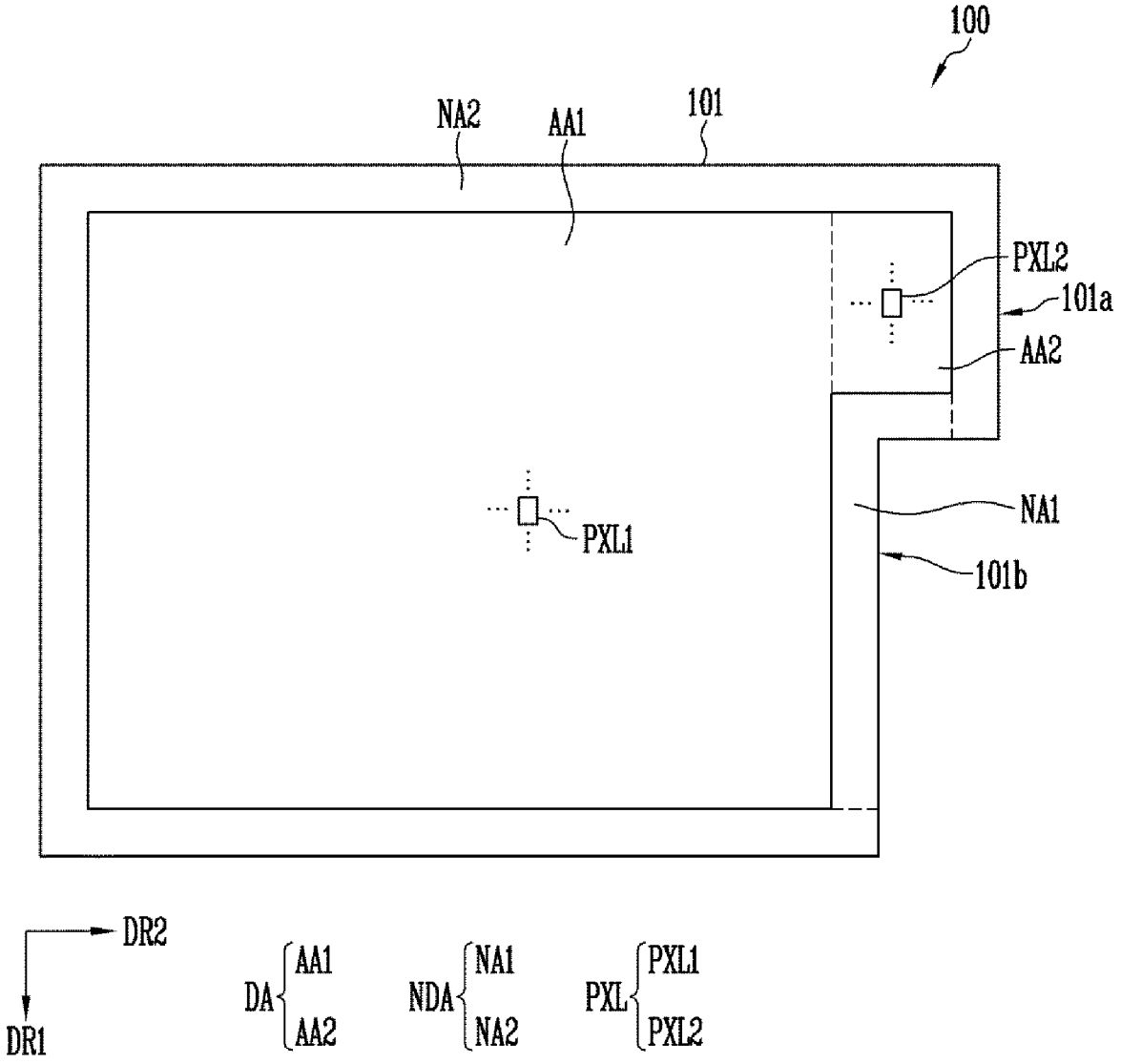

Referring to FIG. 5, the display area DA may include only two pixel areas, e.g., the first and second pixel areas AA1 and AA2, without including the third pixel area AA3. In this case, the first non-pixel area NA1 may be disposed on a first side (e.g., the right side) of the first pixel area AA1 such that the first non-pixel area NA1 borders the first and second pixel areas AA1 and AA2.

Figure 6:
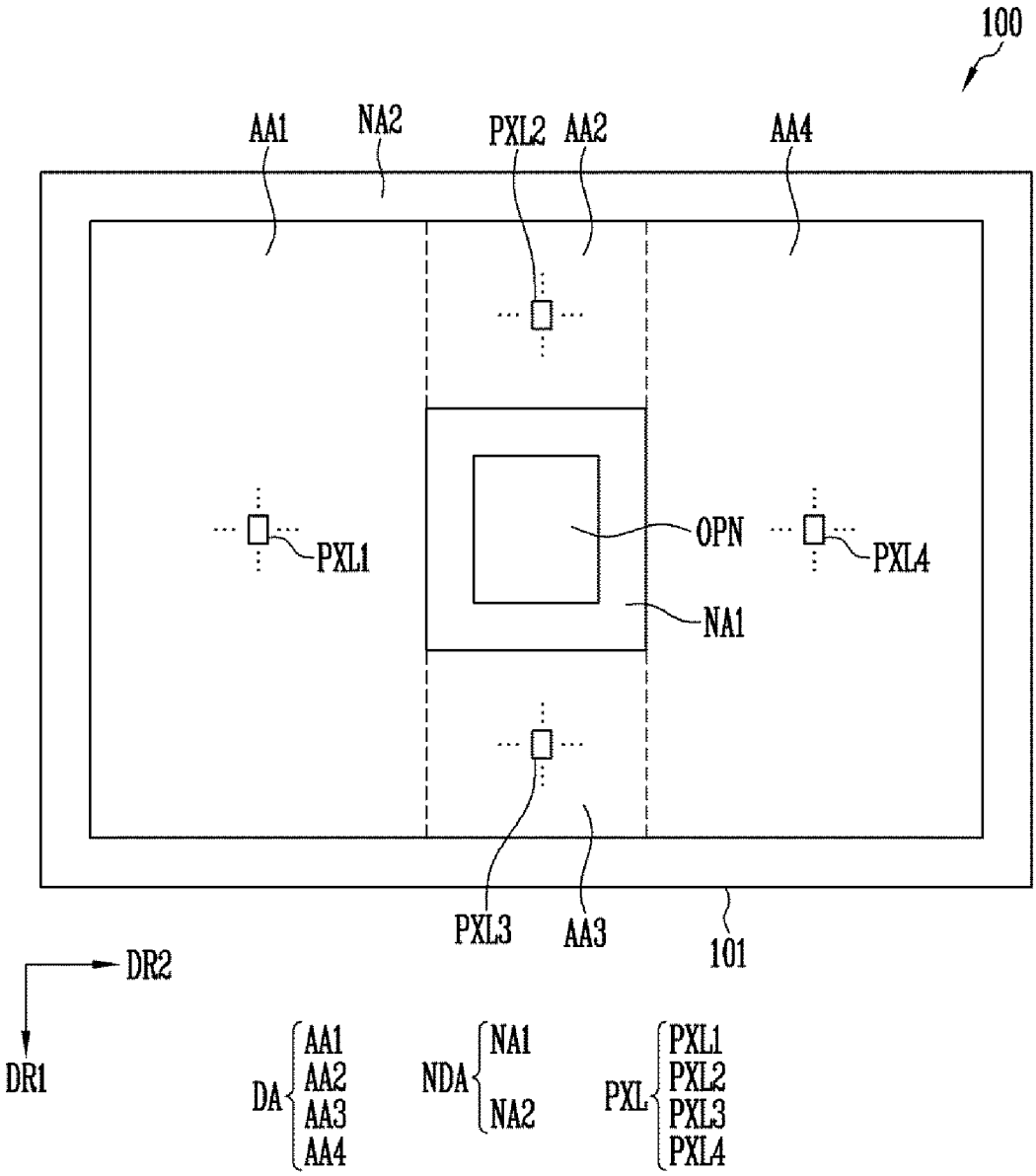

Referring to FIG. 6, at least one opening OPN may be formed in an inside portion (e.g., a central portion) of the display area DA. For example, the display area DA may include four pixel areas which enclose the opening OPN, i.e., may include first, second, third, and fourth pixel areas AA1, AA2, AA3, and AA4, which respectively have first, second, third, and fourth pixel areas PXL1, PXL2, PXL3, and PXL4. The non-display area NDA may border the first to fourth pixels AA1 to AA4 and include a first non-pixel area NA1 having an opening in a central portion thereof. Alternatively, in an embodiment, although the first non-pixel area NA1 may be disposed in an inside portion of the display area DA, the substrate 101 may not have an opening in a portion thereof corresponding to the first non-pixel area NA1.

Figure 7:
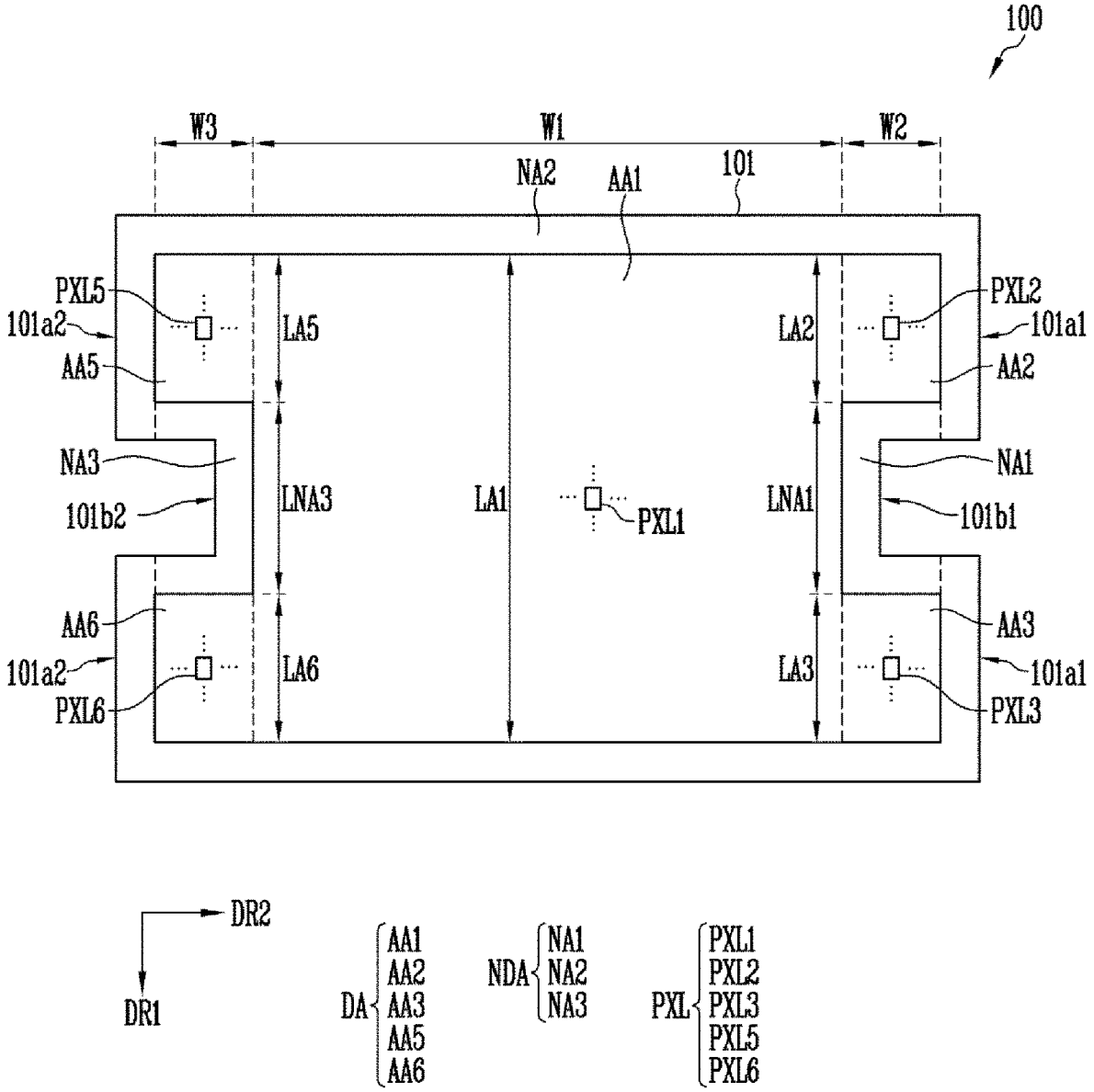

Referring to FIG. 7, the display area DA may further include fifth and sixth pixel areas AA5 and AA6 which are respectively disposed at positions opposite to the second and third pixel areas AA2 and AA3 based on the first pixel area AA1. For example, the second and third pixel areas AA2 and AA3 may be disposed at the right side of the first pixel area AA, and the fifth and sixth pixel areas AA5 and AA6 may be disposed at the left side of the first pixel area AA.

The fifth and sixth pixel areas AA5 and AA6 may respectively include fifth pixels PXL5 and sixth pixels PXL6. In an embodiment, the fifth and/or sixth pixels PXL5 and PXL6 may substantially have the same configuration as that of the first, second, and/or third pixel PXL1, PXL2, and/or PXL3, or may have configurations different from that of the first, second, and/or third pixel PXL1, PXL2, and/or PXL3.

In an embodiment, each of the fifth and sixth pixel areas AA5 and AA6 may have a width W3 and a length LA5, LA6 which are less than those of the first pixel area AA1, and may have an area less than that of the first pixel area AA1. The fifth and sixth pixel areas AA5 and AA6 may have the same shape and/or surface area, or may have different shapes and/or surface areas.

In an embodiment, the fifth and sixth pixel areas AA5 and AA6 may be spaced apart from each other in the first direction DR1. For example, the fifth and sixth pixel areas AA5 and AA6 may be spaced apart from each other in the first direction DR1 with a third non-pixel area NA3 interposed therebetween.

In an embodiment, the substrate 101 may have a shape corresponding to that of the display area DA. For example, the substrate 101 may have first protrusions 101*a* 1 which correspond to the second and third pixel areas AA2 and AA3, second protrusions 101*a* 2 which correspond to the fifth and sixth pixel areas AA5 and AA6, a first recess 101*b*1 which corresponds to the first non-pixel area NA1, and a second recess 101*b*2 which corresponds to the third non-pixel area NA3. For example, the substrate 101 may include a plurality of recesses (i.e., the first and second recesses 101*b*1 and 101*b*2) which are disposed on opposite sides of the first display area AA1. However, the present disclosure is not limited to this. For example, in an embodiment, the substrate 101 may have a rectangular shape regardless of the shape of the display area DA.

As described above, in the display panel 100 in accordance with an embodiment of the inventive concepts, the display area DA and/or the substrate 101 may have various shapes.

Figure 8A:
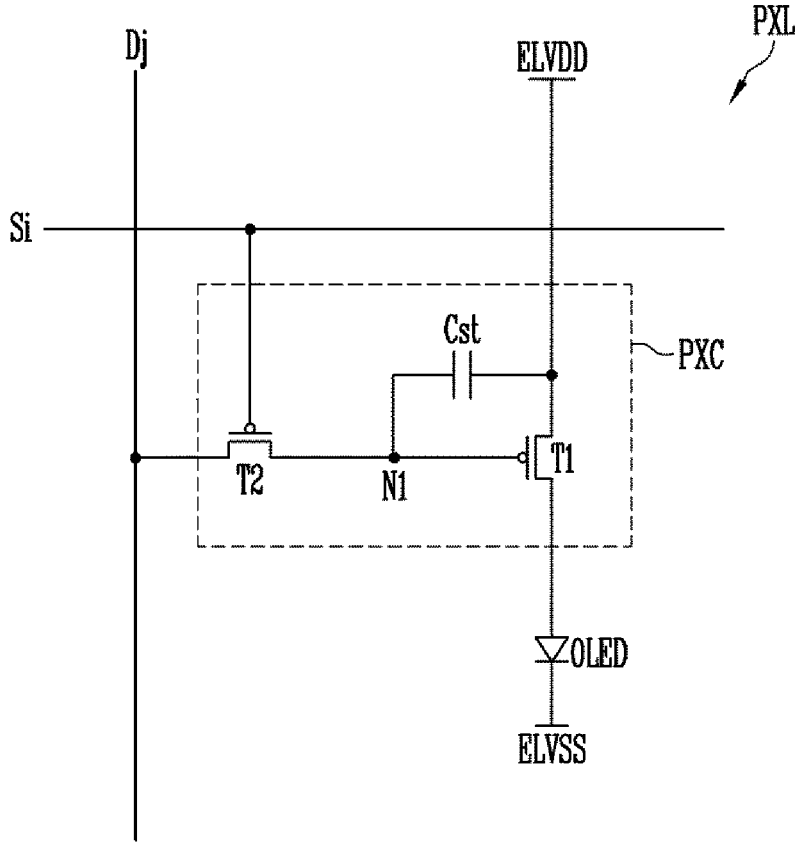
FIGS. 8A and 8B are diagrams illustrating pixels in accordance with respective embodiments.
Figure 8B:
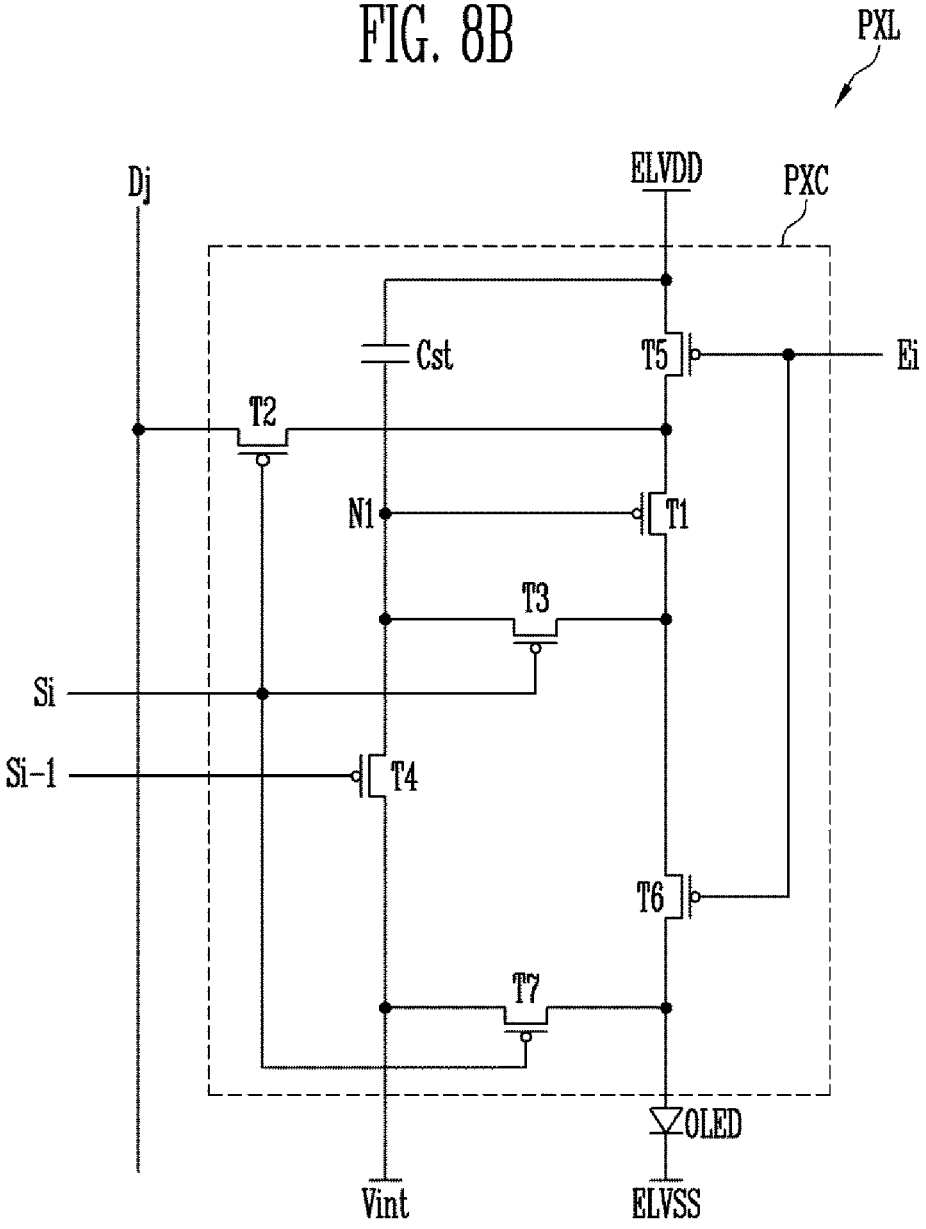

FIGS. 8A and 8B are diagrams illustrating pixels PXL in accordance with respective embodiments. In detail, FIGS. 8A and 8B are circuit diagrams illustrating different examples pertaining to the configuration of each pixel PXL which may be applied to the display device in accordance to an embodiment. For example, at least one of the first to sixth pixels PXL1 to PXL6 shown in FIGS. 1 to 7 may have a structure shown in FIG. 8A or 8B. Although in FIGS. 8A and 8B a pixel PXL of an organic light-emitting display device is illustrated by way of example, the types of pixel PXL and display device in accordance with the present disclosure are not limited thereto.

Referring to FIG. 8A, the pixel PXL in accordance with an embodiment may include an organic light-emitting diode OLED, and a pixel circuit PXC configured to supply driving current corresponding to a data signal to the organic light-emitting diode OLED.

The organic light-emitting diode OLED may be connected between first and second pixel supplies ELVDD and ELVSS. Here, the first and second pixel power supplies ELVDD and ELVSS may have different potentials to allow the organic light-emitting diode OLED to emit light. For example, the first pixel power supply ELVDD may be a high-potential pixel power supply having a predetermined potential. The second pixel power supply ELVSS may be a low-potential pixel power supply having a potential lower than the first pixel power supply ELVDD by a threshold voltage of the organic light-emitting diode OLED or more. When driving current is supplied from the pixel circuit PXC, the organic light-emitting diode OLED may emit light with a luminance corresponding to the driving current.

The pixel circuit PXC may be connected between the first pixel power supply ELVDD and the organic light-emitting diode OLED. The connection location of the pixel circuit PXC may be changed. For example, in an embodiment, the pixel circuit PXC may be connected between the organic light-emitting diode OLED and the second pixel power supply ELVSS.

The pixel circuit PXC may be coupled to a scan line Si and a data line Dj of the corresponding pixel PXL. For example, if the pixel PXL is disposed on an i-th row and a j-th column of the display area DA, the pixel circuit PXC of the pixel PXL may be coupled to an i-th scan line Si and a j-th data line Dj of the display area DA. The pixel circuit PXC may include a first transistor T1, a second transistor T2, and a storage capacitor Cst.

The first transistor (a driving transistor) T1 may be coupled between the first pixel power supply ELVDD and the organic light-emitting diode OLED. A gate electrode of the first transistor T1 is coupled to a first node N1. Here, the first transistor T1 may control, in response to the voltage of the first node N1, driving current flowing from the first pixel power supply ELVDD to the second pixel power supply ELVSS via the organic light-emitting diode OLED.

The second transistor (a switching transistor) T2 may be coupled between the data line Dj and the first node N1. A gate electrode of the second transistor T2 is coupled to the scan line Si. When a scan signal having a turn-on voltage (e.g., a low-level gate-on voltage) is supplied from the scan line Si, the second transistor T2 is turned on to electrically couple the first node N1 to the data line Dj. Here, a data signal of a corresponding frame is supplied to the data line Dj. The data signal is transmitted to the first node N1 via the second transistor T2. Thereby, a voltage corresponding to the data signal is charged to the storage capacitor Cst.

The storage capacitor Cst is coupled between the first pixel power supply ELVDD and the first node N1. The storage capacitor Cst may charge voltage corresponding to a data signal supplied to the first node N1 during a corresponding frame period, and maintain the charged voltage until a data signal of a subsequent frame is supplied.

Although in FIG. 8A the transistors, e.g., the first and second transistors T1 and T2, included in the pixel circuit PXC have been illustrated as being formed of P-type transistors, the present disclosure is not limited to this. In other words, at least one of the first and second transistors T1 and T2 may be changed to an N-type transistor.

In the present disclosure, the structure of the pixel circuit PXC is not limited to that of the embodiment shown in FIG. 8A. For example, the pixel circuit PXC may be configured in the same manner as that of an embodiment shown in FIG. 8B.

Referring to FIG. 8B, the pixel circuit PXC may include first to seventh transistors T1 to T7 and a storage capacitor Cst.

A first electrode of the first transistor T1 may be coupled to the first pixel power supply ELVDD via the fifth transistor T5, and a second electrode thereof may be coupled to the organic light-emitting diode OLED via the sixth transistor T6. A gate electrode of the first transistor T1 is coupled to a first node N1. The first transistor T1 may control driving current to be supplied to the organic light-emitting diode OLED in response to the voltage of the first node N1.

The second transistor T2 is coupled between the data line Dj and the first electrode of the first transistor T1. A gate electrode of the second transistor T2 is coupled to a current scan line, e.g., the scan line Si. When a scan signal is supplied to the scan line Si, the second transistor T2 may be turned on to electrically connect the data line Dj to the first electrode of the first transistor T1. Here, the scan signal may be set to a signal having a gate-on voltage.

The third transistor T3 is coupled between the second electrode of the first transistor T1 and the first node N1. A gate electrode of the third transistor T3 is coupled to the i-th scan line Si. When a scan signal is supplied to the i-th scan line Si, the third transistor T3 may be turned on to electrically connect the second electrode of the first transistor T1 to the first node N1. Therefore, when the third transistor T3 is turned on, the first transistor T1 is connected in the form of a diode.

The fourth transistor T4 may be coupled between the first node N1 and an initialization power supply Vint. A gate electrode of the fourth transistor T4 is coupled to a preceding scan line, e.g., an i-1-th scan line Si-1. However, the present disclosure is not limited to this. For example, in an embodiment, the gate electrode of the fourth transistor T4 may be coupled to other scan lines or a separate control line. When a scan signal having a gate-on voltage is supplied to the i-1-th scan line Si-1, the fourth transistor T4 may be turned on so that the voltage of the initialization power supply Vint may be transmitted to the first node N1. Here, the voltage of the initialization power supply Vint may be set to a minimum voltage of the data signal or less. Therefore, when the fourth transistor T4 is turned on, the first node N1 may be initialized to a voltage less than the voltage of the data signal to allow the first transistor T1 to be connected in the form of a forward biased diode during a subsequent period in which a scan signal is supplied to the i-th scan line Si. Hence, when the scan signal is supplied to the i-th scan line Si, the data signal to be supplied to the data line Dj may be reliably transmitted to the first node N1.

The fifth transistor T5 may be coupled between the first pixel power supply ELVDD and the first transistor T1. A gate electrode of the fifth transistor T5 is coupled to an emission control line, e.g., an i-th emission control line Ei. The fifth transistor T5 may be turned off when an emission control signal having a turn-off voltage, e.g., a high-level gate-off voltage, is supplied to the i-th emission control line Ei, and may be turned on in other cases.

The sixth transistor T6 may be coupled between the first transistor T1 and the organic light-emitting diode OLED. A gate electrode of the sixth transistor T6 may be coupled to the i-th emission control line Ei. The sixth transistor T6 may be turned off when an emission control signal having a gate-off voltage is supplied to the i-th emission control line Ei, and may be turned on in other cases.

The seventh transistor T7 may be coupled between the initialization power supply Vint and the anode electrode of the organic light-emitting diode OLED. A gate electrode of the seventh transistor T7 is coupled to the i-th scan line Si. When a scan signal is supplied to the i-th scan line Si, the seventh transistor T7 is turned on so that the voltage of the initialization power supply Vint may be supplied to the anode electrode of the organic light-emitting diode OLED. Therefore, when the seventh transistor T7 is turned on, the anode voltage of the organic light-emitting diode OLED is initialized.

The storage capacitor Cst is coupled between the first pixel power supply ELVDD and the first node N1. The storage capacitor Cst may store a voltage corresponding to a data signal and the threshold voltage of the first transistor T1 during each frame period.

The structure of the pixel PXL which may be applied to the present disclosure is not limited to the embodiments shown in FIGS. 8A and 8B, and each pixel PXL may have various well-known structures. For instance, the pixel circuit PXC may be formed of a well-known pixel circuit which may have various structures and/or be operated in various driving manners.

Furthermore, in an embodiment, in lieu of the organic light-emitting diode OLED, other types of light-emitting elements may be used as a light source of the pixel. Alternatively, in an embodiment, each pixel PXL may be configured to control transmission of light supplied from a separate light source (e.g., a backlight unit), rather than including a light source.

Figure 9:
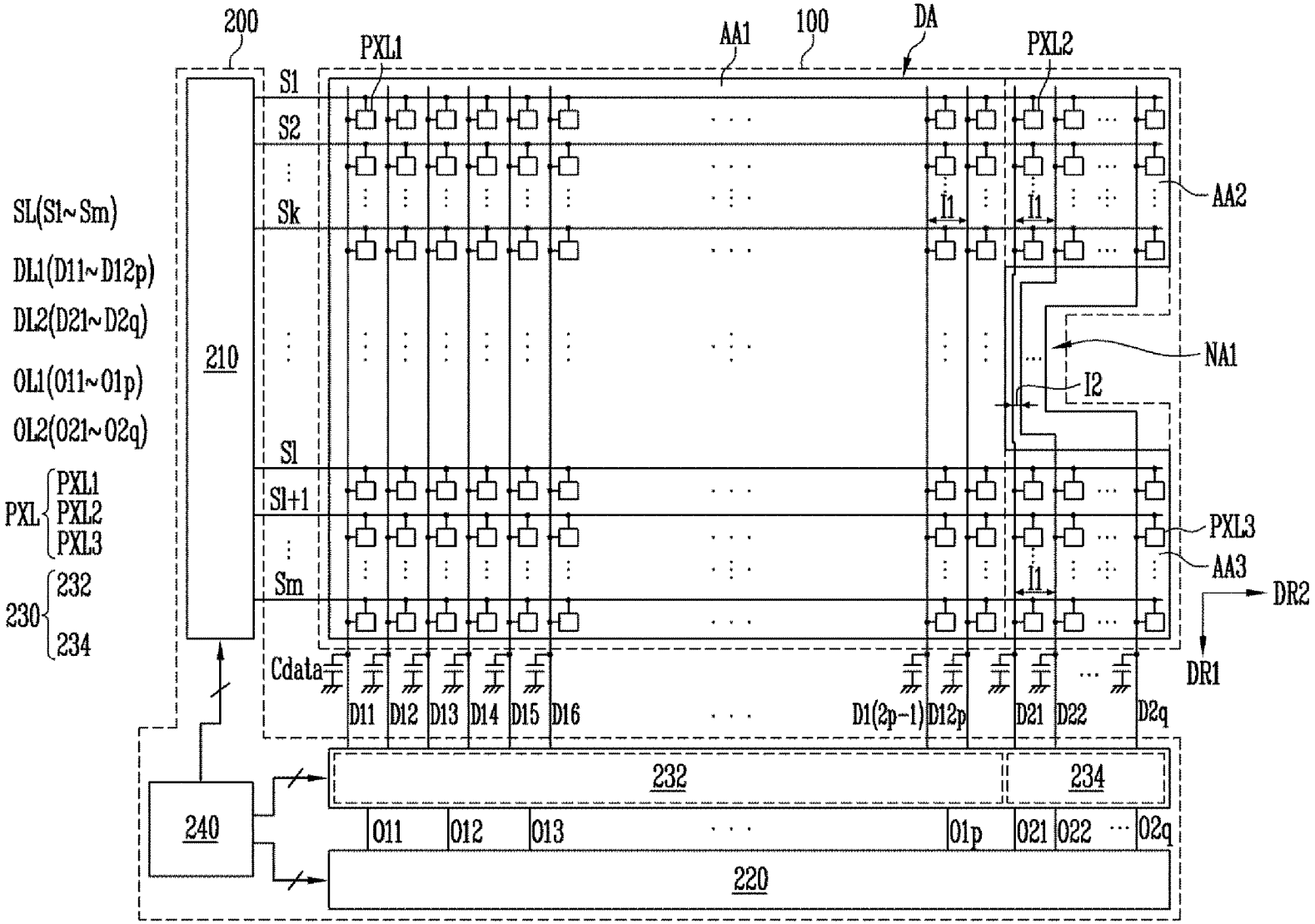
FIG. 9 is a diagram illustrating a display device in accordance with an embodiment.

FIG. 9 is a diagram illustrating a display device in accordance with an embodiment. In this embodiment, the display device shown in FIG. 9 may include the pixels PXL and the display panel 100 according to the embodiments shown in FIGS. 1 to 8B. In the description of the embodiment of FIG. 9, detailed explanation of configurations similar or identical to those of FIGS. 1 to 8B will be omitted.

Referring to FIG. 9, the display device in accordance with the present embodiment may include a display panel 100 having a display area DA and a first non-pixel area NA1, and a driving circuit unit 200 configured to drive pixels PXL of the display panel 100. Although in FIG. 9 the display panel 100 and the driving circuit unit 200 have been illustrated as being separately provided, the present disclosure is not limited thereto. For example, in an embodiment, at least some components, e.g., a scan driver 210, a data driver 220, and/or a switch unit 230, of the driving circuit unit 200 may be integrally provided with the display panel 100 or mounted on the display panel 100.

The display panel 100 may include at least two pixel areas, e.g., first, second, and third pixel areas AA1, AA2, and AA3, and a first non-pixel area NA1. In an embodiment, the first non-pixel area NA1 may be located between the second and third pixel areas AA2 and AA3, and may be disposed, along with the second and third pixel areas AA2 and AA3, on a first side of the first pixel area AA1. In this case, the display area DA may have a recessed shape in a portion thereof corresponding to the first non-pixel area NA1.

The first pixel area AA1 may include first pixels PXL1, and scan lines SL and first data lines DL1 which are coupled to the first pixels PXL1. For example, if the first pixel area AA1 includes a plurality of first pixels PXL1 disposed on m ("m" is a natural number) horizontal lines and 2p ("p" is a natural number) vertical lines, the first pixel area AA1 may include first to m-th scan lines S1 to Sm, and first to 2p-th first data lines D11 to D12*p*.

In an embodiment, the scan lines SL may extend from the first pixel area AA1 in a second direction DR2, e.g., a horizontal direction. The scan lines SL may be coupled to the scan driver 210.

In an embodiment, the first data lines DL1 may extend from the first pixel area AA1 in a first direction DR1, e.g., a vertical direction. The first data lines DL1 may be coupled to the data driver 220 via the switch unit 230. For example, the first data lines DL1 may be coupled to the data driver 220 through a first switch unit 232.

The second pixel area AA2 may include second pixels PXL2, and scan lines SL and second data lines DL2 which are coupled to the second pixels PXL2. For example, if the second pixel area AA2 includes a plurality of second pixels PXL2 disposed on k ("k" is a natural number less than "m") horizontal lines and q ("q" is a natural number) vertical lines, the second pixel area AA2 may include first to k-th scan lines S1 to Sk, and first to q-th second data lines D21 to D2*q*.

In an embodiment, the scan lines SL disposed in the second pixel area AA2 may extend from the second pixel area AA2 in the second direction DR2, e.g., the horizontal direction. Furthermore, each of the scan lines SL disposed in the second pixel area AA2 may be integrally coupled to a corresponding scan line SL disposed on the same row in the first pixel area AA1, and thus, may be coupled to the scan driver 210. However, the present disclosure is not limited to this. For example, in an embodiment, the scan lines SL may be separately provided by pixel areas.

In an embodiment, the second data lines DL2 may extend from the second pixel area AA2 in the first direction DR1, e.g., the vertical direction, and pass through the first non-pixel area NA1. The second data lines DL2 may be coupled to the data driver 220 via the switch unit 230. For example, the second data lines DL2 may be coupled to the data driver 220 through a second switch unit 234.

The third pixel area AA3 may include third pixels PXL3, and scan lines SL and second data lines DL2 which are coupled to the third pixels PXL3. In an embodiment, the third pixel area AA3 may share at least some scan lines SL with the first pixel area AA1, and may share at least some second data lines DL2 with the second pixel area AA2. For example, if the third pixel area AA3 is disposed adjacent to 1-th ("1" is a natural number greater than "k" and less than "m") to m-th horizontal lines of the first pixel area AA1 and includes a plurality of third pixels PXL3 which are disposed on the same q vertical lines as that of the second pixel area AA2, the third pixel area AA3 may include 1-th to m-th scan lines S1 to Sm and first to q-th second data lines D21 to D2*q*.

In an embodiment, the scan lines SL disposed in the third pixel area AA3 may extend from the third pixel area AA3 in the second direction DR2, e.g., the horizontal direction. Furthermore, each of the scan lines SL disposed in the third pixel area AA3 may be integrally coupled to a corresponding scan line SL disposed on the same row in the first pixel area AA1 and thus may be coupled to the scan driver 210. However, the present disclosure is not limited to this.

In an embodiment, the second data lines DL2 may extend from the third pixel area AA3 in the first direction DR1, e.g., the vertical direction, and be coupled to the data driver 220 via the switch unit 230. For instance, the second data lines DL2 may be coupled to the second switch unit 234 after successively passing through the second pixel area AA2, the first non-pixel area NA1, and the third pixel area AA3, and may be coupled to the data driver 220 through the second switch unit 234.

Each of the first and second data lines DL1 and DL2 is provided with a data capacitor Cdata. The data capacitor Cdata may be a capacitor which is equivalently provided on each of the first and second data lines DL1 and DL2. The data capacitor Cdata may temporarily store a data signal to be supplied to a corresponding one of the first and second data lines DL1 and DL2.

The driving circuit unit 200 may include at least one driving circuit configured to drive the display panel 100. For example, the driving circuit unit 200 may include the scan driver 210, the data driver 220, the switch unit 230, and a timing controller 240.

The scan driver 210 may supply scan signals to the respective scan lines SL during each frame period. For instance, the scan driver 210 may sequentially generate scan signals in response to a scan control signal supplied from the timing controller 240, and sequentially supply the scan signals to the first to m-th scan lines S1 to Sm during each frame period.

In the case where emission control lines (e.g., designated by Ei of FIG. 8) are further provided in the display area DA according to the structure of the pixel PXL, the scan driver 210 may supply an i-th emission control signal to an i-th emission control line Ei such that the i-th emission control signal overlaps at least the i-th scan signal. For example, the scan driver 210 may supply an i-th emission control signal having a gate-off voltage to the i-th emission control line Ei such that the i-th emission control signal overlaps the i-1-th and i-th scan signals. Alternatively, in an embodiment, an emission control driver may be separately provided from the scan driver 210, and emission control signals may be supplied to the emission control lines Ei by the separate emission control driver.

The data driver 220 may generate data signals corresponding to the pixels PXL of the display area DA, and output the data signals to first and second output lines OL1 and OL2. For example, the data driver 220 may generate data signals corresponding to the first to third pixels PXL1 to PXL3 in response both to a data control signal supplied from the timing controller 240 and to image data of each frame, and supply the data signals to the first and second data lines DL1 and DL2 respectively through the first and second output lines OL1 and OL2. For example, the data driver 220 may output, to the first and second output lines OL1 and OL2, data signals corresponding to pixels PXL of a horizontal line selected by a scan signal during each horizontal period.

The switch unit 230 may be coupled between the data driver 220 and the first and second data lines DL1 and DL2. The switch unit 230 may transmit data signals output to the first and second output lines OL1 and OL2 of the data driver 220 to the first and second data lines DL1 and DL2, in response to at least one control signal (e.g., at least two control signals having turn-on voltages at different timings) supplied from the timing controller 240 or the like.

In an embodiment, the switch unit 230 may include different types of switch units. For example, the switch unit 230 may include a first switch unit 232 configured to couple the first output lines PL1 of the data driver 220 to the first data lines DL1 in a time-sharing manner by a demuxing scheme during each horizontal period, and a second switch unit 234 configured to couple the second output lines OL2 of the data driver 220 to the second data lines DL2 in a one-to-one manner during the horizontal period.

In this case, the data driver 220 may have first output lines OL1 the number of which is less than the number of first data lines DL1, for example, first to p-th first output lines O11 to O1*p*. The first output lines OL1 may be coupled to the plurality of first data lines DL1 by the first switch unit 232, for example, in such a way that each first output line OL1 is alternately coupled to two corresponding first data lines DL1. In other words, the first output lines OL1 and the first data lines DL1 may be coupled at a ratio of 1:N ("N" is a natural number of 2 or more).

The data driver 220 may have second output lines OL2 the number of which is equal to or greater than the number of second data lines DL2, for example, first to q-th second output lines O21 to O2*q* the number of which is the same as the number of second data lines DL2. The second output lines OL2 may be coupled to different second data lines DL2 by the second switch unit 234. In other words, the second output lines OL2 coupled to the respective second data lines DL2 may be separated from each other, and the second output lines OL2 and the second data lines DL2 may be coupled at a ratio of 1:1.

The timing controller 240 may control the scan driver 210, the data driver 220, and the switch unit 230, in response to various data and driving signals supplied from an external device. For instance, in response to image data and a display driving signal supplied from a host processor, the timing controller 240 may supply a scan control signal to the scan driver 210, may supply rearranged image data and a data control signal to the data driver 220, and may supply first and second control signals (or first and second switching signals) to the switch unit 230.

The display device in accordance with the present embodiment may include the first switch unit 232 which corresponds to at least one area, e.g., the first pixel area AA1, of the display area DA and couples the first output lines OL1 of the data driver 220 to the first data lines DL1 at a ratio of 1:N in a demuxing manner. Thereby, the driving circuit unit 200 and the non-display area (NDA of FIGS. 1 to 6) may be reduced in size.

Furthermore, in the display device in accordance with the present embodiment, even when the display area DA has a non-rectangular shape and includes a demux corresponding to at least one area of the display area DA, uniform image quality may be secured on the entirety of the display area DA. In detail, according to the present embodiment, in the display device in which the display area DA includes the first pixel area AA1 and the second pixel area AA2 protruding from a first side of the first pixel area AA1, the second data lines DL2 extending from the second pixel area AA2 and passing through the first non-pixel area NA1 that border the first and second pixel areas AA1 and AA2 are separately coupled to the different second output lines OL2 of the data driver 220. Therefore, even when the distance between the second data lines DL2 on the first non-pixel area NA1 is reduced to reduce the surface area of the first non-pixel area NA1, a luminance deviation may be prevented from occurring due to coupling between the second data lines DL2.

For example, in the first pixel area AA1, the first data lines DL1 may be arranged at first intervals I1. In addition, in the second and third pixel areas AA2 and AA3, the second data lines DL2 may also be arranged at intervals identical or similar to the first intervals I1. Thus, in the entirety of the display area DA, the first and second data lines DL1 and DL2 may be arranged at uniform intervals. However, in a section in which the second data lines DL2 pass through the first non-pixel area NA1, the second data lines DL2 may be arranged at second intervals 12 smaller than the first intervals I1. In this case, as needed, the size of the non-display area NDA may be effectively reduced by reducing the surface area of the first non-pixel area NA1. For example, the surface area of the first non-pixel area NA1 may be reduced by forming the first non-pixel area NA1 in a recessed shape corresponding to the recessed shape of the display area DA.

Furthermore, the second data lines DL2 are separately coupled to the different second output lines OL2. Therefore, even when a relatively large parasitic capacitance is formed between the second data lines DL2 in the first non-pixel area NA1 due to the reduction in distance between the second data lines DL2, voltage fluctuation of the second data lines DL2 due to coupling between the second data lines DL2 may be prevented or mitigated. Consequently, a luminance deviation in the display area DA may be effectively prevented.

As such, according to the present embodiment, the size of the non-display area NDA may be effectively reduced, and uniform image quality may be secured on the entirety of the display area DA. Particularly, according to the present embodiment, in the display device including the display area DA having a non-rectangular shape, not only may the size of the non-display area NDA be effectively reduced, but uniform image quality may also be secured on the entirety of the display area DA.

Figure 10:
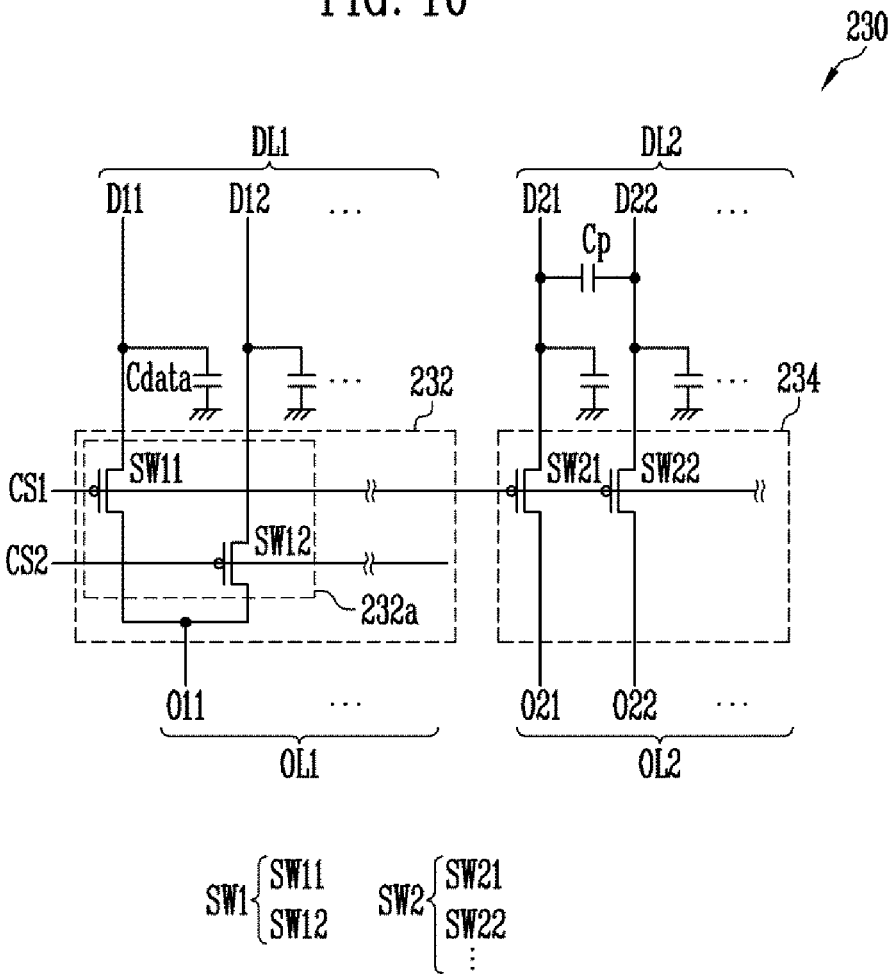
FIG. 10 is a diagram illustrating a switch unit in accordance with an embodiment.

FIG. 10 is a diagram illustrating the switch unit 230 in accordance with an embodiment. For the sake of explanation, FIG. 10 illustrates, to show illustrative configurations of the first and second switch units 232 and 234, only first and second switches SW1 and SW2 and two first and second data lines D11, D12, D21, and D22 coupled to each of the first and second switches SW1 and SW2. Each of the first and second switch units 232 and 234 may have an internal structure in which substantially the same pattern is repeatedly formed. In an embodiment, the switch unit 230 shown in FIG. 10 may be applied to the display device in accordance with the embodiment of FIG. 9. In the description of the embodiment of FIG. 10, detailed descriptions of configurations similar or identical to those of the embodiment of FIG. 9 will be omitted.

Referring to FIGS. 9 and 10, the first switch unit 232 may include at least one demux 232*a* provided to alternately couple each of the first output lines OL1 of the data driver 220 to a plurality of corresponding first data lines DL1. For example, the first switch unit 232 may include a first demux 232*a* provided to couple a 1st first-output line O11 to 1st and 2nd first-data lines D11 and D12 in a time-sharing manner. Likewise, the first switch unit 232 may include a plurality of demuxes 232*a* provided to alternately each of the other first output lines OL1 to a plurality of corresponding first data lines DL1. In other words, the first switch unit 232 may include a plurality of first switches SW1 provided to couple the first output lines OL1 and the first data lines DL1 at a ratio of 1:N.

Each demux 232*a* may include a plurality of first switch switches SW1 configured to be turned on in response to respective different control signals. For example, each demux 232*a* may include a 1-1-th switch SW11 which is turned on in response to a first control signal CS1 to couple any one first output line OL1 to any one first data line DL1, and a 1-2-th switch SW12 which is turned on in response to a second control signal CS2 to couple the any one first output line OL1 to another first data line DL1. Here, the first control signal and the second control signal may have turn-on voltages at different timings. In other words, the 1-1-th and 1-2-th switches SW11 and SW12 may be alternately turned on so that the any one first output line OL1 may be alternately coupled to the two different first data lines DL1. For example, the first demux 232*a* coupled to the 1st first-output line O11 may couple the 1st first-output line O11 of the data driver 220 to the 1st first-data line D11 and the 2nd first-data line D12 of the first pixel area AA1 in a time-sharing manner.

In an embodiment, a pair of first switches SW1, e.g., the 1-1-th and 1-2-th switches SW11 and SW12, of each demux 232*a* may be disposed adjacent to each other in the switch unit 230 and respectively coupled to a pair of first data lines DL1 that are disposed adjacent to each other in the first pixel area AA1. However, the present disclosure is not limited to this. For example, each demux 232*a* may have various known structures.

In this embodiment of FIG. 10, there is illustrated the case where each demux 232*a* alternately couples any one first output line OL1 to two first data lines DL1, but the present disclosure is not limited thereto. For example, each demux 232*a* may couple any one first output line OL1 to three or more first data lines DL1 in a time-sharing manner.

The second switch unit 234 may include second switches SW2 provided to respectively couple the second output lines OL2 of the data driver 220 to the different second data lines DL2. For example, the second switch unit 234 may include a plurality of second switches SW2 provided to couple the second output lines OL2 to the second data lines DL2 at a ratio of 1:1.

Since the second data lines DL2 may be arranged at relatively small intervals, e.g., in the first non-pixel area NA1, a relatively large parasitic capacitance Cp may be formed between the second data lines DL2 compared to that of the first data lines DL2. However, as described above, in an embodiment, the second data lines DL2 are separately coupled to the respective different second output lines OL2, whereby the image quality may be prevented from deteriorating due to a parasitic capacitance Cp formed between the second data lines DL2.

In an embodiment, the second switches SW2 may be turned on in response to an identical control signal so that data signals supplied from the second output lines OL2 may be simultaneously transmitted to the second data lines DL2. For example, the second switches SW2 may be turned on in response to a first control signal CS1 so that the second output lines OL2 may be simultaneously coupled to the second data lines DL2.

In an embodiment, the second switches SW2 that are respectively coupled to the second data lines DL2 disposed adjacent to each other in the second and/or third pixel area AA2 and/or AA3 may be disposed adjacent to each other in the switch unit 230. However, the present disclosure is not limited to this, and the arrangement structure of the second switches SW2 may be changed in various ways.

Data signals supplied from the data driver 220 to the first and second data lines DL1 and DL2 through the first and second output lines OL1 and OL2 and the switch unit 230 may be charged to the respective data capacitors Cdata of the first and second data lines DL1 and DL2 and then supplied to corresponding pixels PXL of a selected horizontal line in response to a scan signal during each horizontal period.

Here, the data driver 220 may alternately supply data signals of first pixels PXL1 coupled to a pair of first data lines DL1 connected to each first output line OL1, to the first output lines OL1 during each horizontal period. Likewise, the data driver 220 may alternately supply data signals of second pixels PXL2 connected to a pair of adjacent second data lines DL2, to some of the second output lines OL2, for example, to second output lines included in a first group consisting of odd-number-th second output lines O21, . . . , during each horizontal period. In other words, in an embodiment, with regard to the first output lines OL1 and the first group of second output lines, the data driver 220 may alternately output data signals of corresponding pixels PXL in a time-sharing manner.

The data driver 220 may swap the data signals that are output to the first group of second output lines, and output the swapped data signals to the other second output lines OL2, e.g., second output lines included in a second group consisting of even-number-th second output lines O22, . . . . In this case, compared to a display device using a general demux structure, only the number of output channels of the data driver 220 is increased to cover an increment in the number of output lines needed to couple the second output lines OL2 to the second data lines DL2 at a ratio of 1:1, and/or only an increased number of data drivers 220 are employed. Data signals of the second pixels PXL2 corresponding to the second group of second output lines may be supplied to the second group of second output lines using a swap function supported by the data driver 220 even without a change of a data signal generating scheme of the data driver 220.

Figure 11:
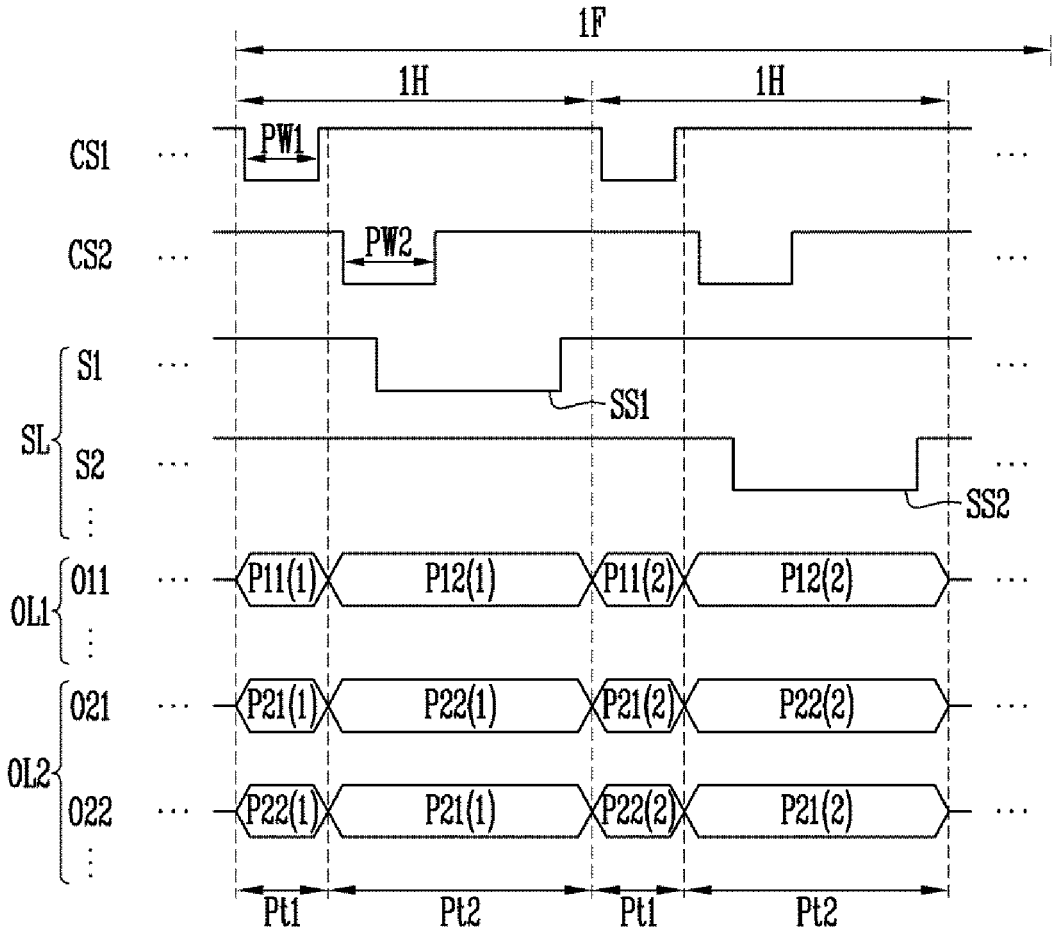
FIG. 11 is a diagram illustrating an embodiment of a method of driving a display device including the switch unit of FIG. 10.

FIG. 11 is a diagram illustrating an embodiment of a method of driving the display device including the switch unit 230 of FIG. 10. Hereinafter, the method of driving the display device in accordance with an embodiment will be described with reference with FIG. 11 along with FIGS. 9 and 10.

Referring to FIGS. 9 to 11, each frame period 1F may include a plurality of horizontal periods corresponding to each horizontal line of the display area DA. Each horizontal period 1H may include a data period in which first and second control signals CS1 and CS2 are sequentially supplied, and a scan period in which scan signals SS1, SS2, . . . of the corresponding horizontal line are supplied. In an embodiment, the data period and the scan period may partially overlap with each other. For example, during a period in which the second control signal CS2 is supplied, the supply of scan signals SS1, SS2, . . . for each horizontal line may start. In this case, time allocated to each horizontal period 1H may be efficiently used so that, even when a duration time of each horizontal period 1H, e.g., in a high-solution display device, is reduced, data signals may be reliably stored in the first and second data lines DL1 and DL2 and the pixels PXL. However, the present disclosure is not limited to this. For example, in an embodiment, the data period and the scan period may be separated from each other without overlapping with each other.

Furthermore, in an embodiment, widths PW1 and PW2 of the first and second control signals CS1 and CS2 may be identical with or different from each other. For instance, if each scan signal SS1, SS2, . . . is supplied to overlap with the second control signal CS2, the width PW2 of the second control signal CS2 may be set to be larger than the width PW1 of the first control signal CS1, whereby data signal may be reliably supplied to the pixels PXL.

During a first period Pt1 of each horizontal period 1H, the data driver 220 may output, to the first output lines OL1, data signals of the first pixels PXL1 that are coupled to the first group of first data lines (e.g., the odd-number-th first data lines D11, . . . ). During a second period Pt2 of each horizontal period 1H, the data driver 220 may output, to the first output lines OL1, data signals of the first pixels PXL1 that are coupled to the second group of first data lines (e.g., the even-number-th first data lines D12, . . . ). In an embodiment, the first period Pt1 may include a period in which the first control signal CS1 is supplied, i.e., a turn-on period of the 1-1-th switches SW11. The second period Pt2 may include a period in which the second control signal CS2 is supplied, i.e., a turn-on period of the 1-2-th switches SW12.

For example, during a first period Pt1 of a first horizontal period 1H corresponding to the first horizontal line of the display area DA, the data driver 220 may output, to the 1st first-output line O11, pixel data P11(1) corresponding to a first pixel PXL1 that is disposed on a first row and a first column of the first pixel area AA1. During a second period Pt2 of the first horizontal period 1H, the data driver 220 may output, to the 1st first-output line O11, pixel data P12(1) corresponding to a first pixel PXL1 that is disposed on the first row and a second column of the first pixel area AA1. Furthermore, during a first period Pt1 of a second horizontal period 1H corresponding to the second horizontal line of the display area DA, the data driver 220 may output, to the 1st first-output line O11, pixel data P11(2) corresponding to a first pixel PXL1 that is disposed on a second row and the first column of the first pixel area AA1. During a second period Pt2 of the second horizontal period 1H, the data driver 220 may output, to the 1st first-output line O11, pixel data P12(2) corresponding to a first pixel PXL1 that is disposed on the second row and the second column of the first pixel area AA1.

Likewise, during the first period Pt1 of the first horizontal period 1H, the data driver 220 may output, to the 1st second-output line O21, pixel data P21(1) corresponding to a second pixel PXL2 that is disposed on a first row and a first column of the second pixel area AA2. During the second period Pt2 of the first horizontal period 1H, the data driver 220 may output, to the 1st second-output line O21, pixel data P22(1) corresponding to a second pixel PXL2 that is disposed on the first row and a second column of the second pixel area AA2. Furthermore, during the first period Pt1 of the second horizontal period 1H, the data driver 220 may output, to the 1st second-output line O21, pixel data P21(2) corresponding to a second pixel PXL2 that is disposed on a second row and the first column of the second pixel area AA2. During the second period Pt2 of the second horizontal period 1H, the data driver 220 may output, to the 1st second-output line O21, pixel data P22(2) corresponding to a second pixel PXL2 that is disposed on a second row and a second column of the second pixel area AA2.

The data driver 220 may swap data signals that are output to the 1st second-output line O21 during each horizontal period 1H, and output the data signals to the 2nd second-output line O22. For example, during the first period Pt1 of the first horizontal period 1H, the data driver 220 may output, to the 2nd second-output line O22, the pixel data P22(1) corresponding to the second pixel PXL2 that is disposed on the first row and the second column of the second pixel area AA2. During the second period Pt2 of the first horizontal period 1H, the data driver 220 may output, to the 2nd second-output line O22, the pixel data P21(1) corresponding to the second pixel PXL2 that is disposed on the first row and the first column of the second pixel area AA2. Likewise, during the first period Pt1 of the second horizontal period 1H, the data driver 220 may output, to the 2nd second-output line O22, the pixel data P22(2) corresponding to the second pixel PXL2 that is disposed on the second row and the second column of the second pixel area AA2. During the second period Pt2 of the second horizontal period 1H, the data driver 220 may output, to the 2nd second-output line O22, the pixel data P21(2) corresponding to the second pixel PXL2 that is disposed on the second row and the first column of the second pixel area AA2.

In other words, in an embodiment, the data driver 220 may supply data signals to the first group of second output lines (e.g., the odd-number-th second output lines O21, . . . ) in a time-sharing manner identical or similar to the scheme of supplying data signals to the first pixel area AA1 using the demux 232*a*. Furthermore, the data driver 220 may output data signals to the second group of second output lines (e.g., the even-number-th second output lines O22, . . . ) by swapping the data signals that are outputted to the first group of second output lines.

For example, during each horizontal period 1H, the data driver 220 may alternately transmit, to the first group of second output lines (e.g., the odd-number-th second output lines O21, . . . ), data signals of second pixels PXL2 coupled to a first group of second data lines (e.g., odd-number-th second data lines D21, . . . ) and data signals of second pixels PXL2 coupled to a second group of second data lines (e.g., even-number-th second data lines D22, . . . ). Furthermore, during each horizontal period 1H, the data driver 220 may swap data signals that are output to the first group of second output lines and output the data signals to the second group of second output lines (e.g., the even-number-th second output lines O22, . . . ).

The data signals outputted to the first output lines OL1 during the first period Pt1 of each horizontal period 1H may be transmitted to the first group of first data lines (e.g., the odd-number-th data lines D11, . . . ) by the 1-1-th switches SW11 that have been turned on in response to the first control signal CS1. Furthermore, the data signals supplied to the second output lines OL2 during the first period Pt1 may be simultaneously transmitted to the second data lines DL2 by the second switches SW2 that have been turned on in response to the first control signal CS1. The data signals supplied to the first output lines OL1 during the second period Pt2 of each horizontal period 1H may be transmitted to the second group of first data lines (e.g., the even-number-th data lines D12, . . . ) by the 1-2-th switches SW12 that have been turned on in response to the second control signal CS2. During the second period Pt2, the second switches SW2 remain turned off, so that the data signals supplied to the second output lines OL2 are not transmitted to the second data lines DL2.

The data signals supplied to the first and second data lines DL1 and DL2 may be transmitted to the corresponding pixels PXL in response to the scan signals SS1, SS2, . . . that are supplied to the corresponding scan lines SL during each horizontal period 1H. In this way, the data signals may be supplied to the pixels PXL of the display area DA during each frame period 1F. Thereby, the pixels PXL may emit light having luminance corresponding to the data signals of each frame, whereby an image corresponding to the data signals is displayed on the display area DA.

Figure 12:
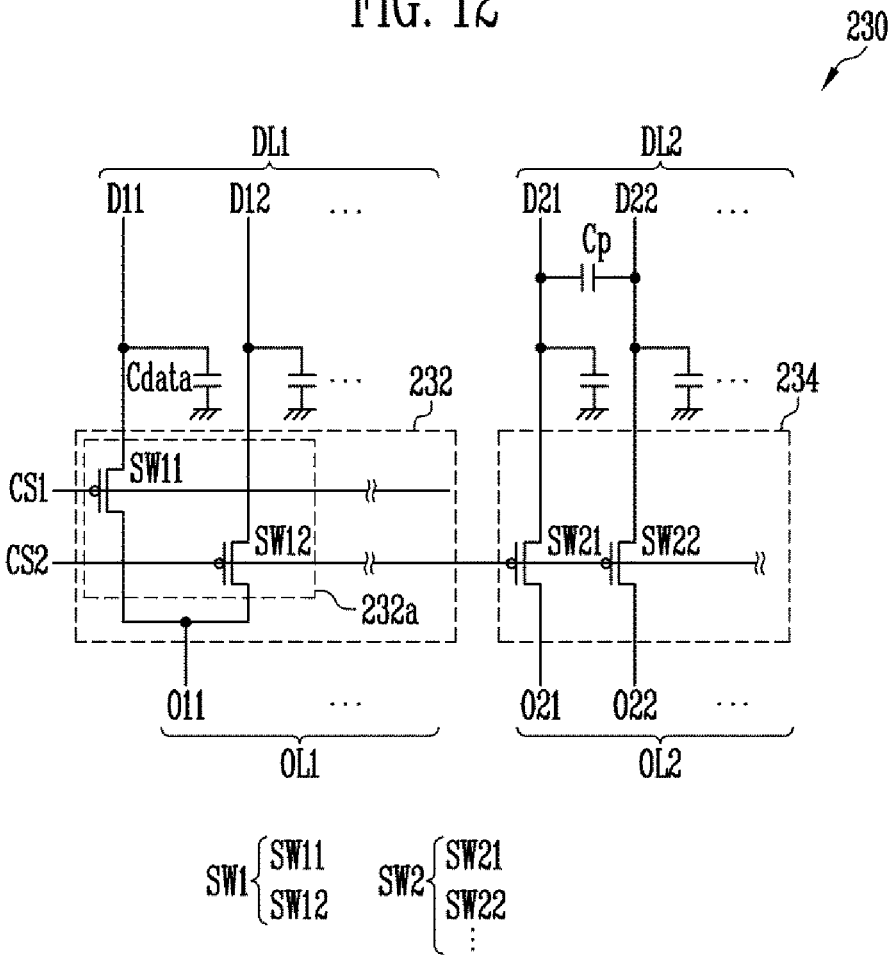
FIG. 12 is a diagram illustrating a switch unit including a modification of a second switch unit of FIG. 10 in accordance with an embodiment.
Figure 13:
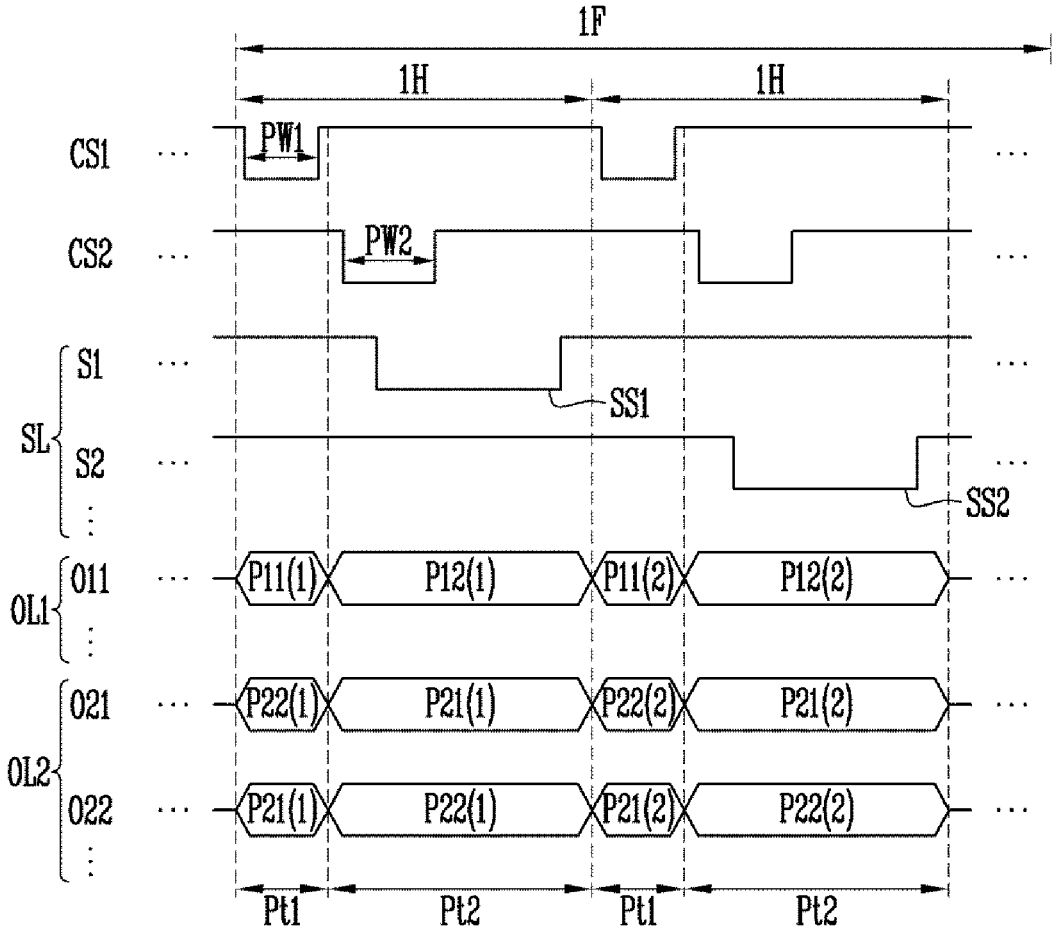
FIG. 13 is a diagram illustrating an embodiment of a method of driving a display device including the switch unit of FIG. 12.

FIG. 12 is a diagram illustrating a switch unit 230 including a modification of the second switch unit 234 of FIG. 10, in accordance with an embodiment. FIG. 13 is a diagram illustrating a method of driving a display device including the switch unit 230 of FIG. 12 in accordance with an embodiment. In the description of the embodiment of FIGS. 12 and 13, detailed explanation of configurations similar or identical to those of FIGS. 10 and 11 will be omitted.

Referring to FIGS. 12 and 13, second switches SW2 included in the second switch unit 234 may be simultaneously turned on in response to a second control signal CS2 to simultaneously couple the second output lines OL2 to the second data lines DL2. In other words, depending on embodiments, any one of a plurality of control signals, e.g., first and second control signals CS1 and CS2, for controlling the first switches SW1 may be selected to simultaneously control the second switches SW2.

The display device according to the present embodiment may be operated in a manner substantially identical or similar to the display device according to the embodiment of FIGS. 10 and 11, other than the fact that data signals to be output from the data driver 220 to the first and second groups of second output lines OL2 are reversed. Therefore, detailed descriptions pertaining to this will be omitted.

Figure 14:
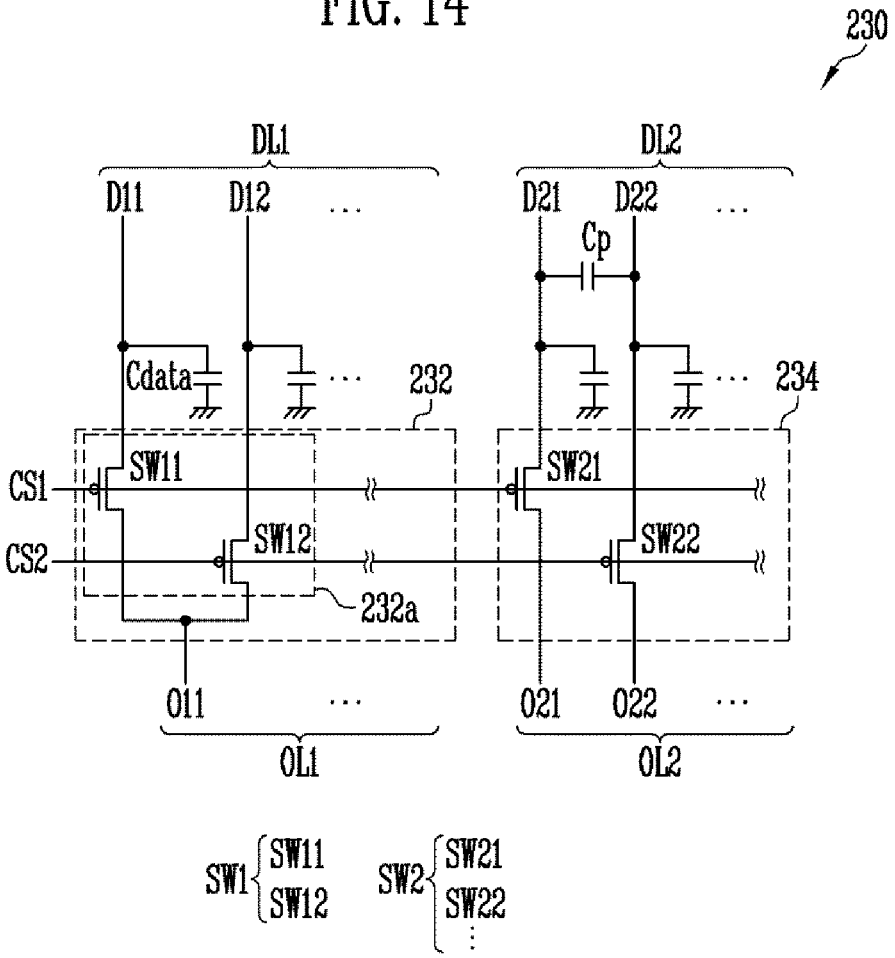
FIG. 14 is a diagram illustrating a switch unit including a modification of a second switch unit of FIG. 10 in accordance with an embodiment.

FIG. 14 is a diagram illustrating a switch unit 230 including a modification of the second switch unit 234 of FIG. 10, in accordance with an embodiment. In the description of the embodiment of FIG. 14, detailed explanation of configurations similar or identical to those of the previously described embodiments will be omitted.

Referring to FIG. 14, second switches SW2 included in the second switch unit 234 may be alternately turned on in response to first and second control signals CS1 and CS2, respectively, so that each second output line OL2 may be coupled to the corresponding second data line DL2.

For example, odd-number-th second switches SW21, . . . coupled between odd-number-th second output lines O21, . . . and odd-number-th data lines D21, . . . corresponding thereto may be turned on in response to the first control signal CS1. Even-number-th second switches SW22, . . . coupled between even-number-th second output lines O22, . . . and even-s number-th data lines D22, . . . corresponding thereto may be turned on in response to the second control signal CS2.

For instance, during each horizontal period 1H, the odd-number-th second output lines O21, . . . may be coupled to the respective odd-number-th data lines D21, . . . by the odd-number-th second switches SW21, . . . during a period in which the first control signal CS1 is supplied. During each horizontal period 1H, the even-number-th second output lines O22, . . . may be coupled to the respective even-number-th data lines D22, . . . by the even-number-th second switches SW22, . . . during a period in which the second control signal CS2 is supplied.

In this case, the data driver 220 may output data signals identical with data signals that are outputted to the first group of second output lines (e.g., the odd-number-th second output lines O21, . . . ), to the second group of second output lines (e.g., the even-number-th second output lines O22, . . . ). For example, the data driver 220 may supply data signals to the respective second output lines OL2 in such a way that a data signal that is supplied to the 1st second-output line O21 of FIG. 11 is supplied to the 2nd second output line O22, and likewise, a data signal that is supplied to the 3rd second-output line O23 is supplied to the 4th second-output line O24.

Alternatively, in an embodiment, in contrast, the odd-number-th second switches SW21, . . . may be turned on in response to the second control signal CS2, and the even-number-th second switches SW22, . . . may be turned on in response to the first control signal CS1. For example, during each horizontal period 1H, the even-number-th second output lines O22, . . . may be coupled to the respective even-number-th data lines D22, . . . by the even-number-th second switches SW22, . . . during a period in which the first control signal CS1 is supplied. During each horizontal period 1H, the odd-number-th second output lines O21, . . . may be coupled to the respective odd-number-th data lines D21, . . . by the odd-number-th second switches SW21, . . . during a period in which the second control signal CS2 is supplied. In this case, the data driver 220 may supply data signals to the respective second output lines OL2 in such a way that a data signal that is supplied to the 1st second-output line O21 of FIG. 13 is supplied to the 2nd second output line O22, and likewise, a data signal that is supplied to the 3rd second-output line O23 is supplied to the 4th second-output line O24.

According to the embodiments of FIGS. 9 to 14, the data driver 220 may supply data signals to the second output lines OL2 coupled one-to-one to the second data lines DL2, using the data swap scheme and the demuxing scheme. Furthermore, the second switch unit 234 may supply data signals to at least some of the second data lines DL2 during a period in which data signals are supplied to at least some of the first data lines DL1, using the first and/or second control signals CS1 and CS2 for controlling the data output timing of the first switch unit 232. According to these embodiments, the times it takes to charge the first and second data lines DL1 and DL2 may be generally uniform. Consequently, a data charging deviation between the first to third pixel areas AA1, AA2, and AA3 may be prevented, and uniform image quality may be secured on the entirety of the display area DA.

Figure 15:
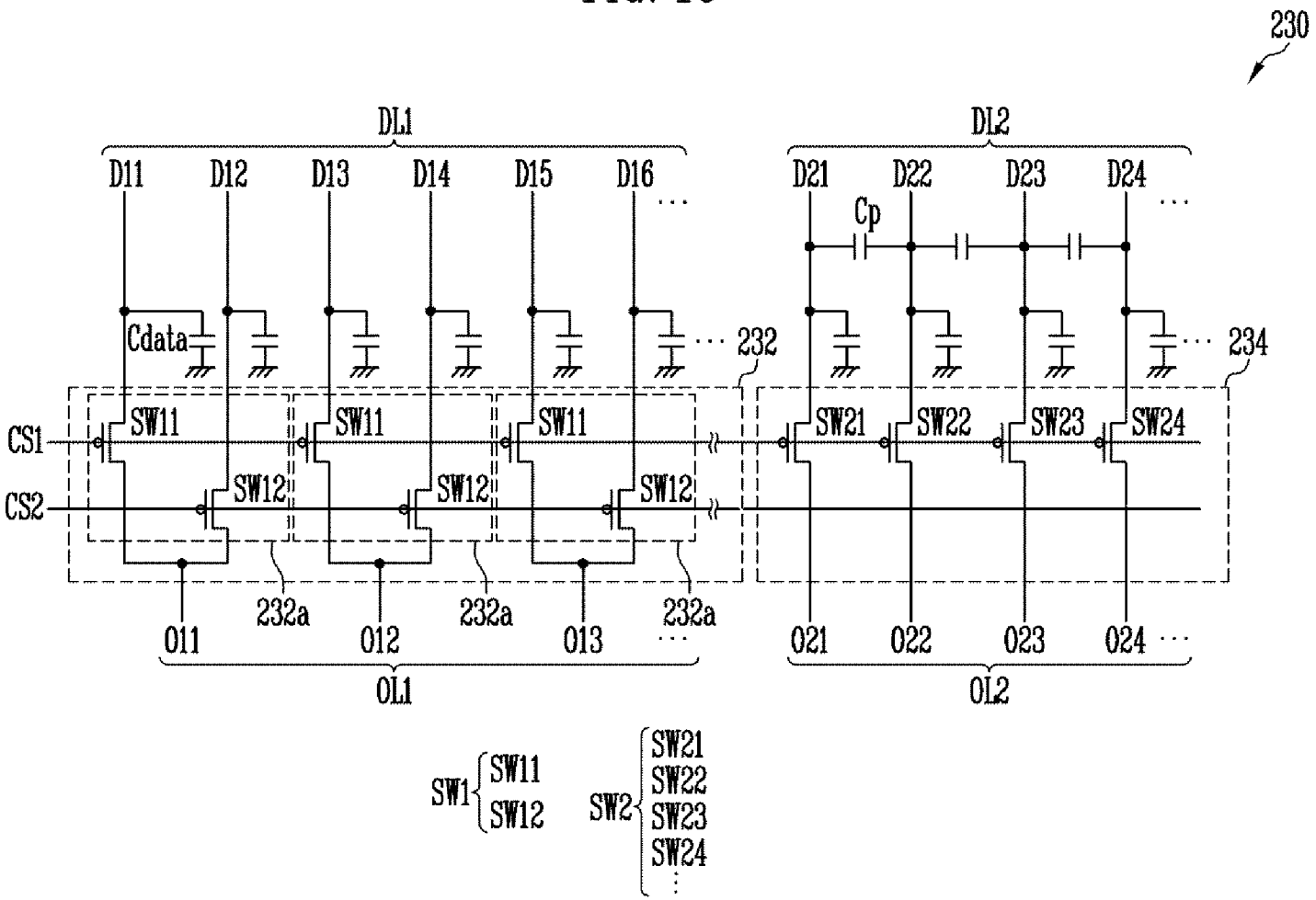
FIGS. 15 and 16 are diagrams respectively illustrating switch units including respective different modifications of a first switch unit of FIG. 10 in accordance with embodiments.
Figure 16:
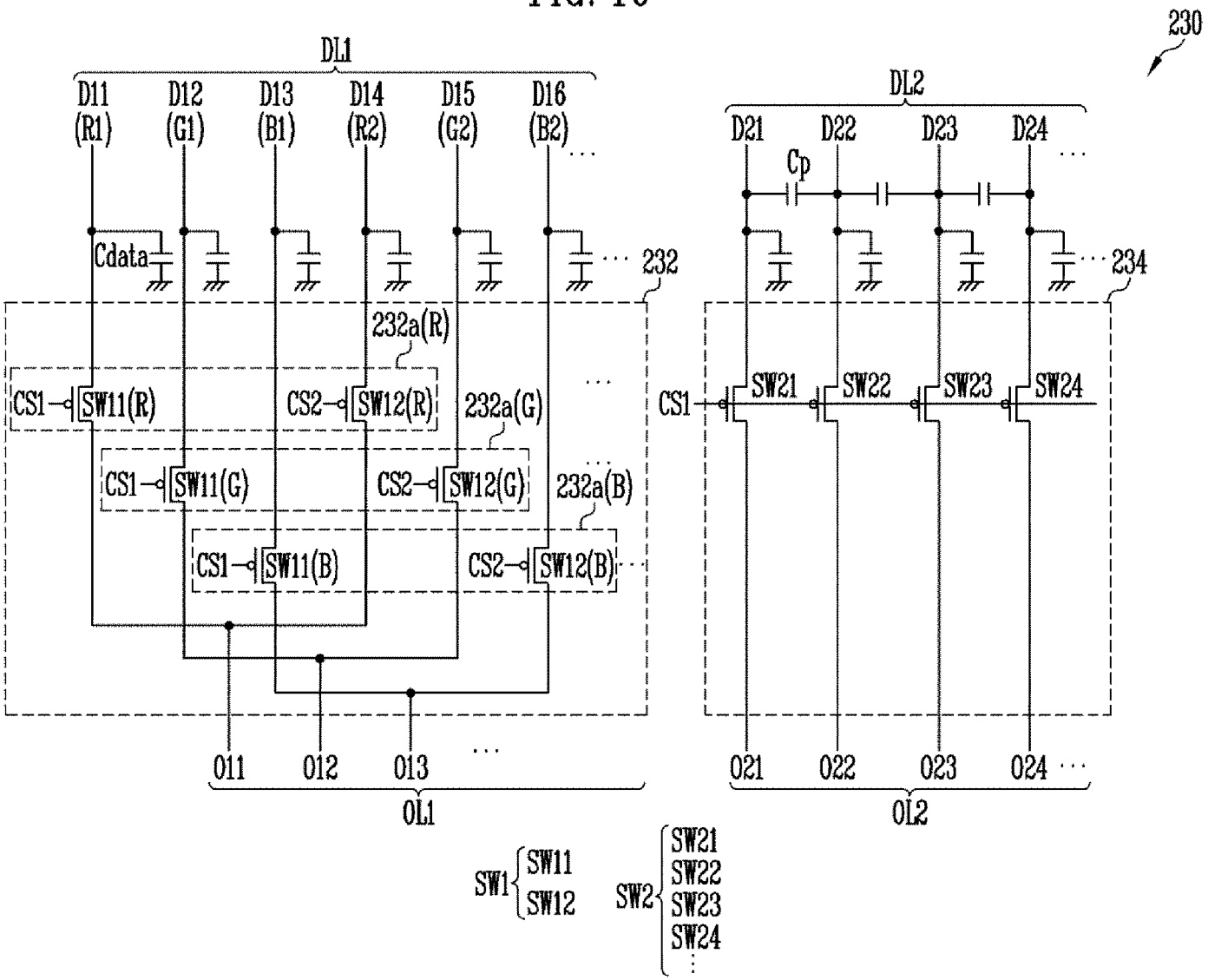

FIGS. 15 and 16 are diagrams respectively illustrating switch units 230 including respective different modifications of the first switch unit 232 of FIG. 10 in accordance with embodiments. In the description of the embodiments of FIGS. 15 and 16, detailed explanation of configurations similar or identical to those of the previously described embodiments will be omitted.

Referring to FIG. 15, the first switch unit 232 may include a plurality of demuxes 232*a* each of which is connected between a corresponding first output line OL1 and a pair of adjacent first data lines DL1. For example, each two first data lines DL1 which are successively disposed may make a pair and be coupled to the corresponding first output line OL1 through the corresponding demux 232*a*. In this case, each demux 232*a* may include a 1-1-th switch SW11 which is turned on in response to a first control signal CS1 to couple any one of the pair of first data lines DL1 to the corresponding first output line OL1, and a 1-2-th switch SW12 which is turned on in response to a second control signal CS2 to couple the other one of the pair of first data lines DL1 to the corresponding first output line OL1.

The second switch unit 234 may have the same structure as that of any one of the previously described embodiments. For example, the second switch unit 234 may include a plurality of second switches SW2 which are simultaneously turned on in response to the first control signal CS1.

Referring to FIG. 16, the first switch unit 232 may be configured to divide the first pixels PXL1 coupled to the first data lines DL1 by color. For example, each demux 232*a* may include 1-1-th and 1-2-th switches SW11 and SW12 which are respectively disposed on two adjacent columns in the first pixel area AA1 and respectively coupled to first data lines DL1 of corresponding first pixels PXL1 that emit the same color light.

For instance, a first demux 232*a* (R) coupled to the 1st first-output line O11 may include a 1-1-th switch SW11(R) which is connected to a data line D11 of first red pixels R1 that are disposed on the respective horizontal lines of the first pixel area AA1 and is turned on in response to a first control signal CS1, and a 1-2-th switch SW12(R) which is connected to a data line D14 of second red pixels R2 disposed on the respective horizontal lines of the first pixel area AA1 and is turned on in response to a second control signal CS2. Furthermore, a second demux 232*a* (G) coupled to the 2nd first-output line O12 may include a 1-1-th switch SW11(G) which is connected to a data line D12 of first green pixels G1 that are disposed on the respective horizontal lines of the first pixel area AA1 and is turned on in response to the first control signal CS1, and a 1-2-th switch SW12(G) which is connected to a data line D15 of second green pixels G2 disposed on the respective horizontal lines of the first pixel area AA1 and is turned on in response to the second control signal CS2. A third demux 232*a* (B) coupled to the 3rd first-output line O13 may include a 1-1-th switch SW11(B) which is connected to a data line D13 of first blue pixels B1 that are disposed on the respective horizontal lines of the first pixel area AA1 and is turned on in response to the first control signal CS1, and a 1-2-th switch SW12(B) which is connected to a data line D16 of second blue pixels B2 disposed on the respective horizontal lines of the first pixel area AA1 and is turned on in response to the second control signal CS2.

In the present disclosure, the structure of the first switch unit 232 is not limited to that of the embodiments shown in FIGS. 15 and 16. For example, the first switch unit 232 may have various known demux structures.

Figure 17:
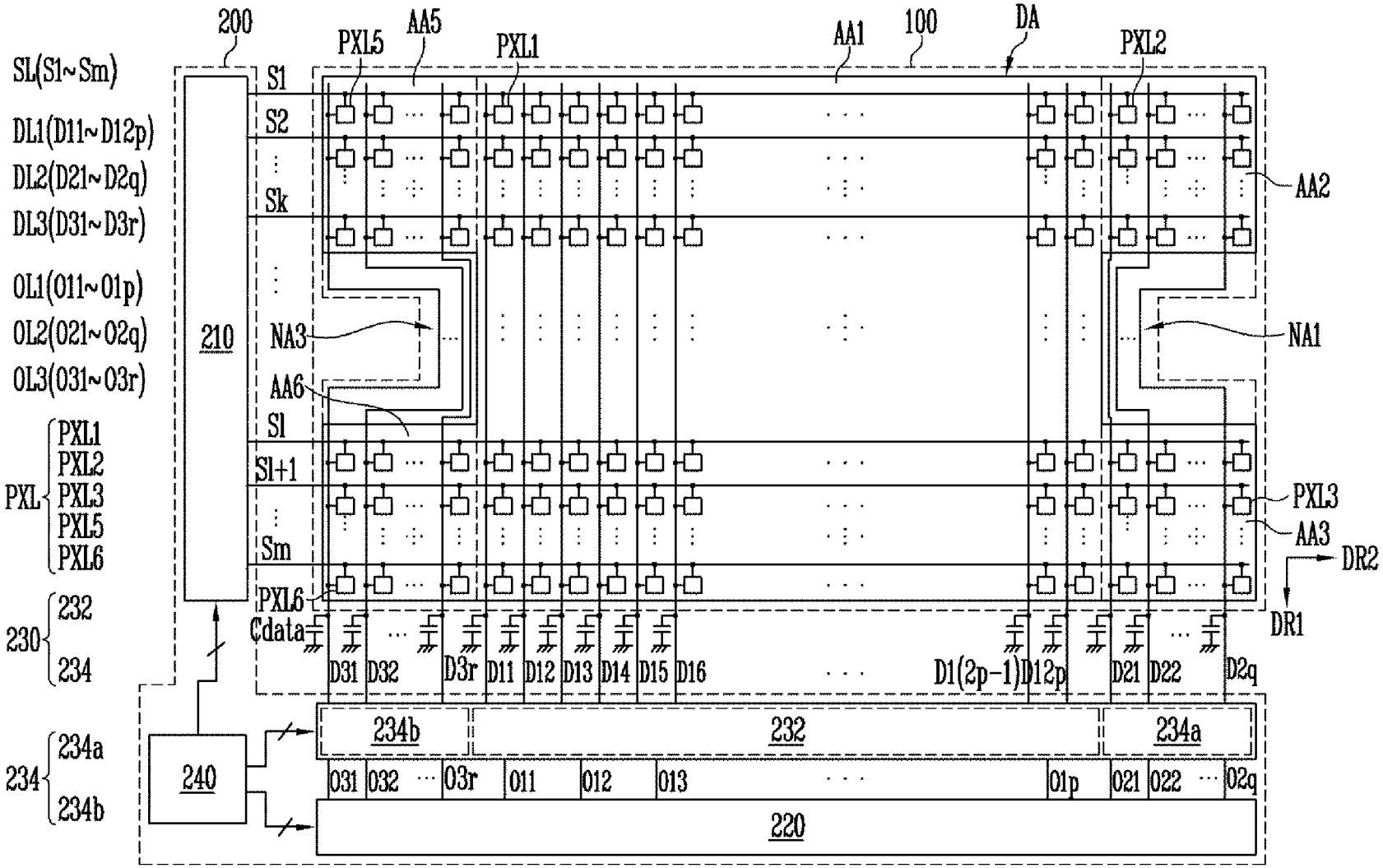
FIG. 17 is a diagram illustrating a display device in accordance with an embodiment.

FIG. 17 is a diagram illustrating a display device in accordance with an embodiment. In the following description of the embodiment of FIG. 17, components similar or equal to those of the previously described embodiments, e.g., the embodiment shown in FIGS. 7 and 9, will be designated by like reference numerals, and detailed descriptions thereof will be omitted.

Referring to FIG. 17, the display area DA may include a first pixel area AA1, second and third pixel areas AA2 and AA3 which are disposed on a first side of the first pixel area AA1 at positions spaced apart from each other with a first non-pixel area NA1 interposed therebetween, and fifth and sixth pixel areas AA5 and AA6 which are disposed on a second side of the first pixel area AA1 at positions spaced apart from each other with a third non-pixel area NA3 interposed therebetween. The display area DA may have a recessed shape on each of opposite sides (e.g., the left side and the right side) corresponding to the first non-pixel area NA1 and the third non-pixel area NA3.

The fifth pixel area AA5 may include fifth pixels PXL5, and scan lines SL and third data lines DL3 which are coupled to the fifth pixels PXL5. For example, if the fifth pixel area AA5 includes a plurality of fifth pixels PXL5 disposed on k horizontal lines and r ("r" is a natural number) vertical lines, the fifth pixel area AA5 may include first to k-th scan lines Si to Sk, and first to r-th third data lines D31 to D3*r*. Although in FIG. 17 the fifth pixel area AA5 has been illustrated as including the same number of horizontal lines as that of the second pixel area AA2, the present disclosure is not limited thereto. For example, in an embodiment, the second and fifth pixel areas AA2 and AA5 may have different numbers of horizontal lines.

In an embodiment, the scan lines SL disposed in the fifth pixel area AA5 may extend from the fifth pixel area AA5 in the second direction DR2, e.g., the horizontal direction. Furthermore, each of the scan lines SL disposed in the fifth pixel area AA5 may be integrally coupled to a corresponding one of the scan lines SL disposed on the same row in the first pixel area AA1 and thus may be coupled to the scan driver 210. However, the present disclosure is not limited to this. For example, in an embodiment, the scan lines SL may be separately provided by pixel areas.

In an embodiment, the third data lines DL3 may extend from the fifth pixel area AA5 in the first direction DR1, e.g., the vertical direction, and pass through the third non-pixel area NA3. The third data lines DL3 may be coupled to the data driver 220 via the switch unit 230. For example, the third data lines DL3 may be coupled to the data driver 220 through the second switch unit 234 (e.g., a second switch group 234*b* of the second switch unit 234).

The sixth pixel area AA6 may include sixth pixels PXL6, and scan lines SL and third data lines DL3 which are coupled to the sixth pixels PXL6. In an embodiment, the sixth pixel area AA6 may share at least some scan lines SL with the first pixel area AA1, and may share at least some third data lines DL3 with the fifth pixel area AA5. For example, if the sixth pixel area AA6 is disposed adjacent to 1-th ("1" is a natural number greater than "k" and less than "m") to m-th horizontal lines of the first pixel area AA1 and includes a plurality of sixth pixels PXL6 which are disposed on the same r vertical lines as that of the fifth pixel area AA5, the sixth pixel area AA6 may include 1-th to m-th scan lines S1 to Sm and first to r-th third data lines D31 to D3*r*.

In an embodiment, the scan lines SL disposed in the sixth pixel area AA6 may extend from the sixth pixel area AA6 in the second direction DR2, e.g., the horizontal direction. Furthermore, each of the scan lines SL disposed in the sixth pixel area AA6 may be integrally coupled to a corresponding scan line SL disposed on the same row in the first pixel area AA1 and thus may be coupled to the scan driver 210. However, the present disclosure is not limited to this.

In an embodiment, the third data lines DL3 may extend from the sixth pixel area AA6 in the first direction DR1, e.g., the vertical direction, and be coupled to the data driver 220 via the switch unit 230. For instance, the third data lines DL3 may be coupled to the second switch unit 234 (e.g., the second switch group 234*b* of the second switch unit 234) after successively passing through the fifth pixel area AA5, the third non-pixel area NA3, and the sixth pixel area AA6, and may be coupled to the data driver 220 through the second switch unit 234.

Each of the third data lines DL3 is provided with a data capacitor Cdata. The data capacitor Cdata may be a capacitor which is equivalently provided on each of the third data lines DL3. The data capacitor Cdata may temporarily store a data signal to be supplied to a corresponding one of the third data lines DL3.

In the present embodiment, the data driver 220 may generate data signals corresponding to the pixels PXL of the display area DA, and output the data signals to first, second, and third output lines OL1, OL2, and OL3. For example, the data driver 220 may generate data signals corresponding to the first, second, third, fifth, and sixth pixels PXL1, PXL2, PXL3, PXL5, and PXL6 in response both to a data control signal supplied from the timing controller 240 and to image data of each frame, and supply the data signals to the first, second, and third data lines DL1, DL2, and DL3 respectively through the first, second, and third output lines OL1, OL2, and OL3. For example, the data driver 220 may output, to the first, second, and third output lines OL1, OL2, and OL3, data signals corresponding to pixels PXL of a horizontal line selected by a scan signal during each horizontal period.

In the present embodiment, the second switch unit 234 may include a first switch group 234*a* configured to couple the second output lines OL2 of the data driver 220 to the second data lines DL2 at a ratio of 1:1 during each horizontal period, and a second switch group 234*b* configured to couple the third output lines OL3 of the data driver 220 to the third data lines DL3 at a ratio of 1:1 during each horizontal period. In an embodiment, the first and second switch groups 234*a* and 234*b* may be disposed on respective opposite sides of the first switch unit 232. For example, the first switch group 234*a* may be disposed on the right side of the first switch unit 232, and the second switch group 234*b* may be disposed on the left side of the first switch unit 232.

In an embodiment, the data driver 220 may have third output lines OL3 the number of which is equal to or greater than the number of third data lines DL3, for example, first to r-th third output lines O31 to O3*r* the number of which is the same as the number of third data lines DL3. The third output lines OL3 may be coupled to different third data lines DL3 by the second switch group 234*b* of the second switch unit 234. In other words, the third output lines OL3 coupled to the respective third data lines DL3 may be separated from each other, and the third output lines OL3 and the third data lines DL3 may be coupled at a ratio of 1:1. Hence, even when the third data lines DL3 are arranged at relatively small intervals in the third non-pixel area NA3, etc., the image quality may be prevented from deteriorating due to a parasitic capacitance formed between the third data lines DL3.

Since the above-described display device according to the present embodiment includes the switch unit 230 corresponding to the shape of the display area DA, the size of the non-display area NDA may be effectively reduced, and uniform image quality may be secured on the entirety of the display area DA.

Figure 18A:
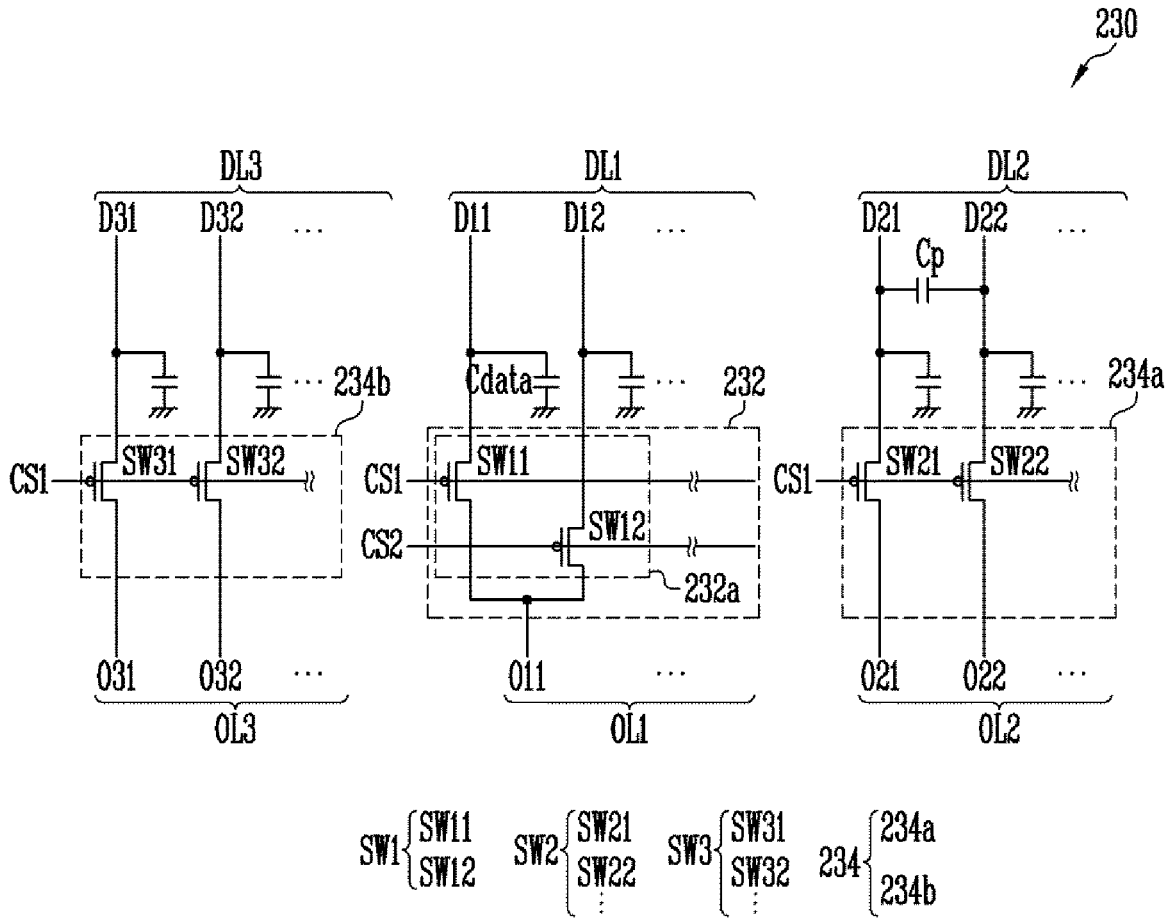
FIGS. 18A, 18B, and 18C are diagrams respectively illustrating switch units including different modifications of a second switch unit of FIG. 17 in accordance with embodiments.
Figure 18B:
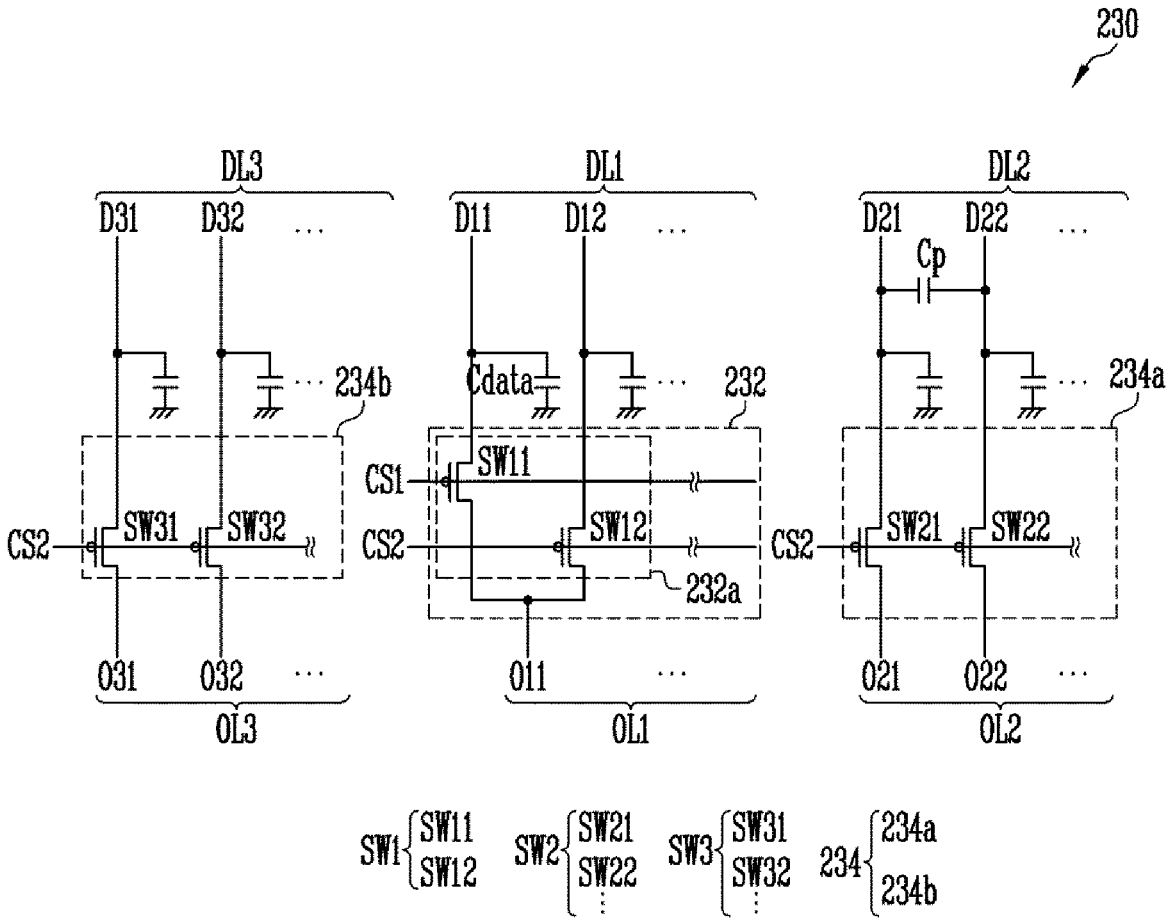
Figure 18C:
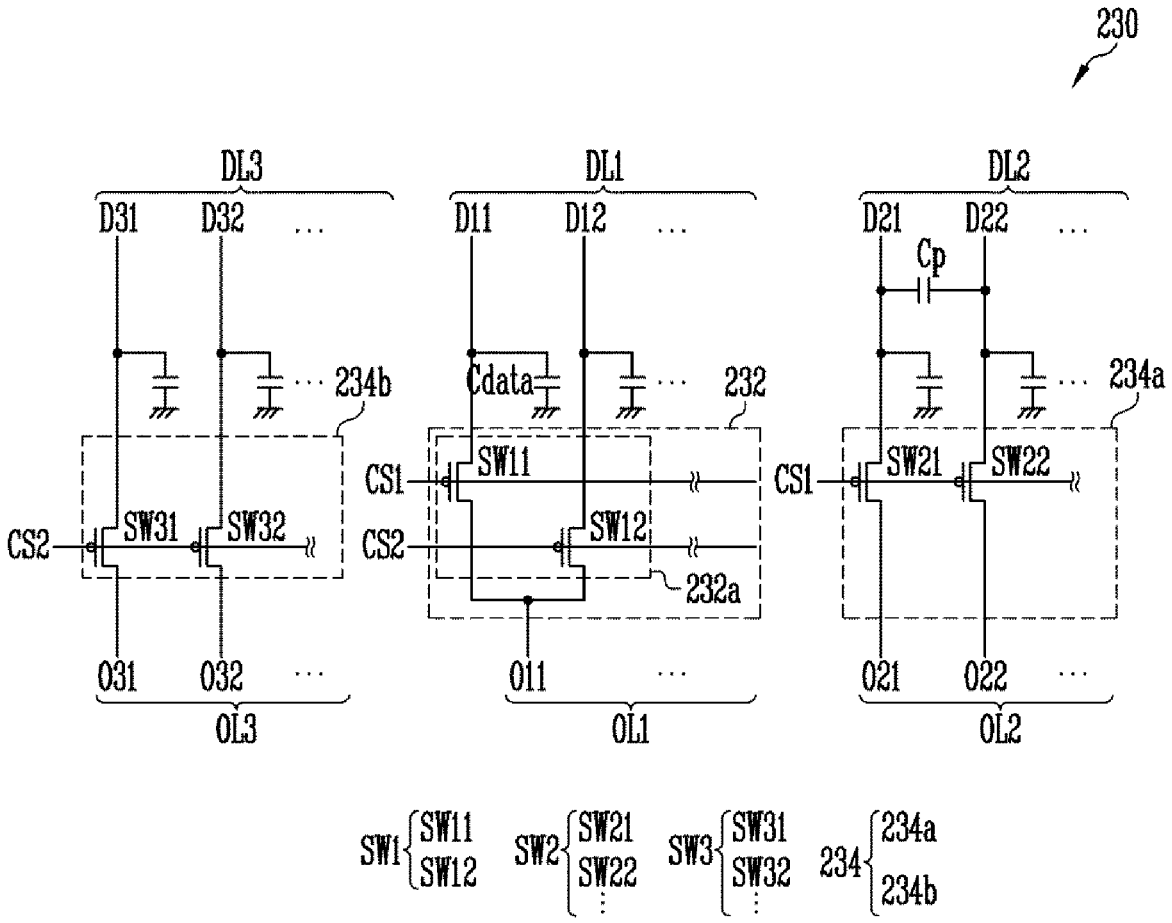

FIGS. 18A to 18C are diagrams respectively illustrating switch units 230 including respective different modifications of the second switch unit 234 of FIG. 17 in accordance with embodiments. In the description of the embodiments of FIGS. 18A to 18C, detailed explanation of configurations similar or identical to those of the previously described embodiments will be omitted.

Referring to FIGS. 17 and 18A to 18C, the second switch unit 234 may include the first switch group 234*a* which is coupled between the second output lines OL2 of the data driver 220 and the second data lines DL2, and the second switch group 234*b* which is coupled between the third output lines OL3 of the data driver 220 and the third data lines DL3.

The first switch group 234*a* may include second switches SW2 provided to respectively couple the second output lines OL2 of the data driver 220 to the different second data lines DL2. For example, the first switch group 234*a* may include a plurality of second switches SW2 provided to couple the second output lines OL2 to the second data lines DL2 at a ratio of 1:1.

The second switch group 234*b* may include third switches SW3 provided to respectively couple the third output lines OL3 of the data driver 220 to the different third data lines DL3. For example, the second switch group 234*b* may include a plurality of third switches SW3 provided to couple the third output lines OL3 to the third data lines DL3 at a ratio of 1:1.

In an embodiment, the first and second switch groups 234*a* and 234*b* may be driven by the same control signal, or may be respectively driven by different control signals. For example, the second and third switches SW2 and SW3 may be simultaneously turned on in response to a first control signal CS1 or a second control signal CS2, as shown in FIGS. 18A and 18B, or may be alternately turned on in response to different control signals of the first and second control signals CS1 and CS2, as shown in FIG. 18C.

As such, in various embodiments, the second switch unit 234 may have various configurations and be driven in various ways depending on the shape of the display area DA.

Various embodiments may provide a display device including a demux corresponding to at least one area, e.g., a first pixel area, of a display area. Hence, the sizes of a driving circuit unit and a non-display area may be reduced.

Furthermore, in an embodiment, a second pixel area is disposed on one side of a first pixel area, and a first non-pixel area is disposed to border the first and second pixel areas. Second data lines extending from the second pixel area and passing through the first non-pixel area are separately coupled to respective output lines of a data driver. Therefore, even if the distance between the second data lines is reduced on the first non-pixel area, a luminance deviation may be prevented from occurring due to coupling between the second data lines. Consequently, the size of the non-display area may be more effectively reduced, and uniform image quality may be secured on the entirety of the display area.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a first pixel area including first pixels and first data lines coupled to the first pixels;

a second pixel area including second pixels and second data lines coupled to the second pixels, and having a length less than a length of the first pixel area with respect to a first direction, the second pixel area being disposed on one side of the first pixel area with respect to a second direction;

a first non-pixel area disposed on the one side of the first pixel area with respect to the second direction such that the first non-pixel area borders the first and second pixel areas;

a data driver configured to output data signals corresponding to the first and second pixels through first and second output lines, respectively; and a switch unit coupled between the first and second output lines and the first and second data lines, wherein the switch unit comprises:

a first switch unit comprising a demultiplexer (demux) configured to alternately couple each of the first output lines to a plurality of corresponding first data lines in a ratio of 1:N, where N is a natural number of 2 or more; and a second switch unit configured to couple each of the second output lines to one of the respective different second data lines in a ratio of 1:1.

2. The display device according to claim 1, wherein the second switch unit comprises a plurality of second switches configured to couple the second output lines with the second data lines at the ratio of 1:1.

3. The display device according to claim 2, wherein the first switch unit comprises a plurality of first switches configured to couple the first output lines with the first data lines at the ratio of 1:N.

4. The display device according to claim 1, wherein the demux comprises:

a 1-1-th switch configured to be turned on in response to a first control signal so that one of the first output lines is coupled to one of the first data lines; and a 1-2-th switch configured to be turned on in response to a second control signal so that the one of the first output lines is coupled to another one of the first data lines.

5. The display device according to claim 4, wherein the first and second control signals respectively have turn-on voltages at different timings.

6. The display device according to claim 4, wherein the 1-1-th and 1-2-th switches are respectively coupled to two first data lines disposed adjacent to each other in the first pixel area.

7. The display device according to claim 6, wherein the 1-1-th and 1-2-th switches are disposed adjacent to each other.

8. The display device according to claim 4, wherein the 1-1-th and 1-2-th switches are respectively coupled to first data lines connected to first pixels that are provided to emit same color light and disposed on two different columns in the first pixel area.

9. The display device according to claim 4, wherein the second switch unit comprises a plurality of second switches configured to be simultaneously turned on in response to one of the first and second control signals so that the second output lines are simultaneously coupled to the respectively second data lines.

10. The display device according to claim 4, wherein the second switch unit comprises a plurality of second switches configured to be alternately turned on in response to the first and second control signals so that each of the second output lines is coupled to a corresponding one of the second data lines.

11. The display device according to claim 1, wherein the first data lines extend from the first pixel area in the first direction and are coupled to the data driver through the first switch unit, and wherein the second data lines extend from the second pixel area in the first direction, pass through the first non-pixel area, and are coupled to the data driver through the second switch unit.

12. The display device according to claim 11, wherein the first data lines are arranged in the first pixel area at a first interval, and wherein the second data lines are arranged in at least one portion of the first non-pixel area at a second interval less than the first interval.

13. The display device according to claim 12, wherein the second data lines are arranged in the second pixel area at the first interval.

14. The display device according to claim 1, wherein, during a first period of each horizontal period, the data driver outputs, to the first output lines, data signals of first pixels coupled to a first group of first data lines, and wherein, during a second period of the each horizontal period, the data driver outputs, to the first output lines, data signals of first pixels coupled to a second group of first data lines.

15. The display device according to claim 14, wherein, during each horizontal period, the data driver alternately outputs, to a first group of second output lines, data signals of second pixels coupled to a first group of second data lines and data signals of second pixels coupled to a second group of second data lines, and wherein, during the each horizontal period, the data driver swaps the data signals that are output to the first group of second output lines, and outputs the swapped data signals to a second group of second output lines.

16. The display device according to claim 1, further comprising a third pixel area disposed on the one side of the first pixel area such that the third pixel area faces the second pixel area with the first non-pixel area interposed therebetween, and borders the first pixel area and the first non-pixel area.

17. The display device according to claim 16, wherein the third pixel area includes third pixels coupled to the second data lines.

18. A method of driving a display device including a first pixel area, and a second pixel area and a first non-pixel area which are disposed on one side of the first pixel area, the method comprising:

alternately coupling each of first output lines of a data driver to a plurality of first data lines disposed in the first pixel area in a ratio of 1:N where N is a natural number of 2 or more, in response to first and second control signals sequentially supplied during each horizontal period; and coupling, at a ratio of 1:1, second output lines of the data driver to second data lines disposed in the second pixel area, in response to at least one of the first and second control signal during the each horizontal period.

19. The method according to claim 18, wherein the second output lines are simultaneously coupled to the second data lines in response to one of the first and second control signals during the each horizontal period.

20. The method according to claim 18, wherein some of the second output lines are respectively coupled to corresponding ones of the second data lines in response to the first control signal during a first period of the each horizontal period, and wherein some of the second output lines are respectively coupled to corresponding ones of the second data lines in response to the second control signal during a second period of the each horizontal period.

* * * * *